US008893529B1

(12) United States Patent
Inli

(10) Patent No.: US 8,893,529 B1
(45) Date of Patent: Nov. 25, 2014

(54) TOE CLOSING APPARATUS

(71) Applicant: Da Kong Enterprise Co., Ltd., Changhua (TW)

(72) Inventor: Mustafa Inli, Istanbul (TR)

(73) Assignee: Da Kong Enterprise Co., Ltd., Changhua (TW)

( * ) Notice: Subject to any disclaimer, the term of this patent is extended or adjusted under 35 U.S.C. 154(b) by 0 days.

(21) Appl. No.: 14/220,082

(22) Filed: Mar. 19, 2014

(30) Foreign Application Priority Data

Nov. 15, 2013 (TW) ..... 102141695 A

(51) Int. Cl.
*D04B 9/56* (2006.01)
*D05B 23/00* (2006.01)

(52) U.S. Cl.
CPC ..... *D05B 23/009* (2013.01); *D04B 9/56* (2013.01)
USPC ..... 66/148

(58) Field of Classification Search
CPC ..... D04B 9/40; D04B 9/46; D04B 1/26; D04B 9/56; D05B 23/007; D05B 23/009
USPC ..... 66/148, 147, 149 R, 150, 152, 153; 112/475.12, 470.08
See application file for complete search history.

(56) References Cited

U.S. PATENT DOCUMENTS 5,551,260 A * 9/1996 Frullini et al. ..... 66/148
5,586,453 A * 12/1996 Frullini et al. ..... 66/148
6,826,930 B2 * 12/2004 Frullini et al. ..... 66/148
8,028,546 B2 * 10/2011 Lonati et al. ..... 66/148
8,443,633 B1 * 5/2013 Inli ..... 66/148

FOREIGN PATENT DOCUMENTS

TW 201144506 12/2011

* cited by examiner

*Primary Examiner* — Danny Worrell
(74) *Attorney, Agent, or Firm* — DLA Piper LLP (US)

(57) ABSTRACT

An apparatus for closing a toe end of a tubular hosiery body includes a stitching device having a main body, a fixed reed, a movable reed pivoted to the fixed reed, and a main drive assembly for driving the movable reed to rotate relative to the fixed reed between juxtaposed and stacked positions. A rotary control unit includes a support frame supporting the main body, a rotary disc attached to the main body, a plurality of detent members disposed around the rotary disc, and a plurality of control drive members respectively driving the detent members. The control drive members consecutively operate to consecutively actuate the respective detent members such that the rotary disc together with the stitching device consecutively produces a limited amount of rotation in an intermittent manner.

11 Claims, 22 Drawing Sheets

TOE CLOSING APPARATUS

CROSS REFERENCE APPLICATION

This application claims priority of Taiwanese Patent Application No. 102141695, filed on Nov. 15, 2013.

BACKGROUND OF THE INVENTION

1. Field of the Invention

This invention relates to hosiery equipment, more particularly to an apparatus for closing the toes of a hosiery item.

2. Description of the Related Art

A hosiery item, for example, a stocking, after being manufactured in a knitting machine, generally has a tubular shape with two opposite ends that are open. The stocking has to be sent to another machine for closing one of the ends thereof, that is, the toe end.

In Taiwanese Patent Publication No. 201144506, it is disclosed that a hosiery body, for example, a stocking body, made by a knitting machine can be transferred to a stitching apparatus using a transfer unit of this application. The stitching apparatus includes two semi-circular reeds, a plurality of male reed teeth arranged spaced apart from each other around a semi-circumference of one of the reeds, a plurality of female reed teeth arranged spaced apart from each other around a semi-circumference of the other reed, and a sewing needle. The reeds are pivotable relative to each other between a stacked position, where the reeds are superimposed one above the other, and a juxtaposed position, where the reeds are disposed side by side in a same plane. When the reeds are in the juxtaposed position, a plurality of transfer and strip members of the transfer unit can transfer loops at the toe end of the stocking body from the knitting machine to the reeds, after which the reeds are pivoted relative to each other to the stacked position. The sewing needle is then used to stitch the loops together to thereby close the toe of the stocking.

However, there is no disclosure as to what kind of structure is used to achieve movement of the reeds between the stacked and juxtaposed positions. If a stepper motor is used to activate intermittent rotation of the reeds, because each stroke angle of the stepper motor is small, intermittent frequency will be high. Not only is the cost increased, but the machine is likely to get damaged. Further, there is also no disclosure of a rotary drive means for the needle to proceed with the stitching of the loops.

Moreover, in U.S. Patent Publication No. 2004/0211226, although a rotary actuator, such as a pneumatic cylinder, is used to achieve rotations of the semicrowns between stacked and juxtaposed positions, the entire structure thereof is complicated and has a large volume.

SUMMARY OF THE INVENTION

Therefore, the object of the present invention is to provide an apparatus that can accomplish a transfer operation of a hosiery body and a stitching operation to close a toe end of the hosiery body using a simple structure.

According to this invention, an apparatus for closing a toe end of a tubular hosiery body knitted by a knitting machine comprises a stitching device, a transfer unit and a rotary control unit. The stitching device includes a main body defining a longitudinal axis and having opposite top and bottom ends, a fixed reed fixed to the bottom end and having a plurality of first reed teeth, a movable reed pivoted to the fixed reed and having a plurality of second reed teeth, and a main drive assembly for driving the movable reed to rotate relative to the fixed reed between a juxtaposed position, where the movable reed is disposed side by side with the fixed reed in a same plane, and a stacked position, where the movable reed is stacked below the fixed reed. The stitching device further includes a sewing needle for executing a stitching operation when the movable reed is in the stacked position. The first and second reed teeth mate with each other along an axial direction that is parallel to the longitudinal axis when the movable reed is in the stacked position. The transfer unit is used for transferring the toe end of the hosiery body from the knitting machine to the stitching device and for positioning the toe end on the fixed reed and the movable reed. The rotary control unit includes a support frame supporting the main body of the stitching device, a rotary disc attached to the top end of the main body and having a plurality of angularly spaced-apart engaging elements, a plurality of angularly spaced-apart detent members pivoted to the support frame and disposed around the rotary disc, and a plurality of control drive members respectively driving the detent members. Each of the control drive members is operative to actuate a respective one of the detent members to drive a limited amount of rotation of the rotary disc. The engaging elements move past the detent members when the rotary disc is rotated. Each detent member cams one of the engaging elements that is closed thereto to drive the limited amount of rotation of the rotary disc when actuated by the respective one of the control drive members. The control drive members consecutively operate to consecutively actuate the respective detent members such that the rotary disc together with the stitching device consecutively produces a limited amount of rotation in an intermittent manner.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
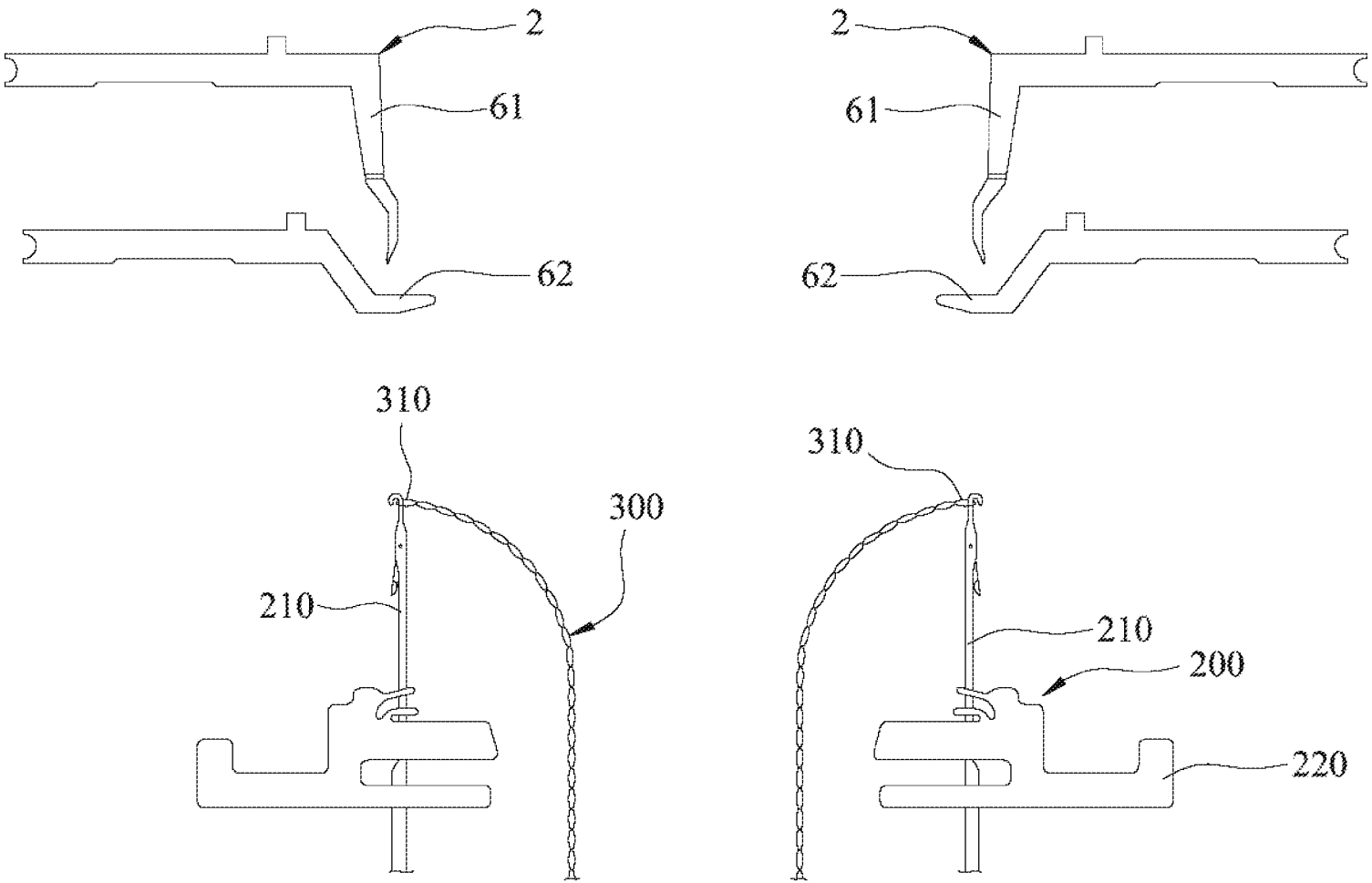
FIG. 1 is a schematic view of a transfer unit of an apparatus for closing a toe end of a tubular hosiery body according to the preferred embodiment of the present invention and a knitting machine.

Referring to FIGS. 1 to 23, an apparatus according to the preferred embodiment of the present invention is used for closing a toe end 310 of a tubular hosiery body 300 knitted by a knitting machine 200. The knitting machine 200 includes a plurality of knitting needles 210 and a plurality of sinkers 220. The toe closing apparatus comprises a stitching device 1, a transfer unit 2 and a rotary control unit 3.

With reference to FIGS. 4 to 7, the stitching device 1 includes a main body 10, a fixed reed 20, a movable reed 30, a main drive assembly 40, an auxiliary drive assembly 50, and a sewing needle 101.

The main body 10 is a hollow cylinder that defines a longitudinal axis (L), and has a top end 11, a bottom end 12 opposite to the top end 11 along the longitudinal axis (L), and an accommodating space 13 extending from the top end 11 to the bottom end 12.

Figure 7:
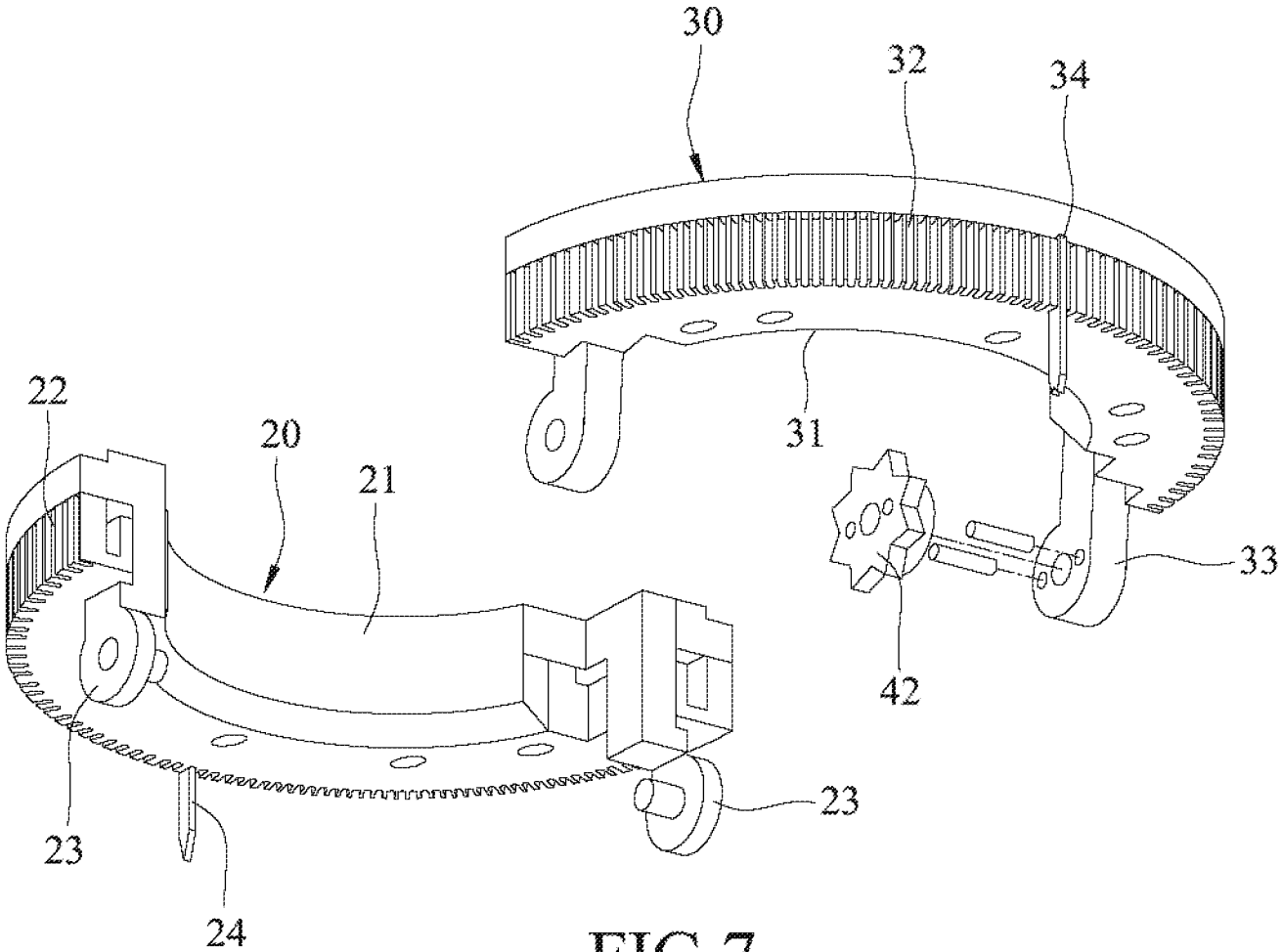
FIG. 7 is a perspective view of the movable reed and the fixed reed of the stitching device.

The fixed reed 20 is fixed to the bottom end 12, is semicircular in shape, and has a first inner surface 21, a first outer surface 22 opposite to the first inner surface 21, a pair of first pivot lugs 23 that extend downwardly from the first inner surface 21 so as to be disposed on a bottom side of the fixed reed 20 and that are spaced apart from each other at an angle of 180°, and a plurality of angularly spaced-apart first reed teeth 24 (only one is shown in FIG. 7) arranged on the first outer surface 22. Each of the first reed teeth 24 is a male reed tooth having a tip end 241.

The movable reed 30 is semicircular in shape, and has a second inner surface 31, a second outer surface 32 opposite to the second inner surface 31, a pair of second pivot lugs 33 that extend downwardly from the second inner surface 31 so as to be disposed on a bottom side of the movable reed 30, that are spaced apart from each other at an angle of 180° and that are respectively and pivotally connected to the first pivot lugs 23, and a plurality of angularly spaced-apart second reed teeth 34 (only one is shown in FIG. 7) arranged on the second outer surface 32. Each of the second reed teeth 34 is a female reed tooth 341 having a notched end.

Figure 4:
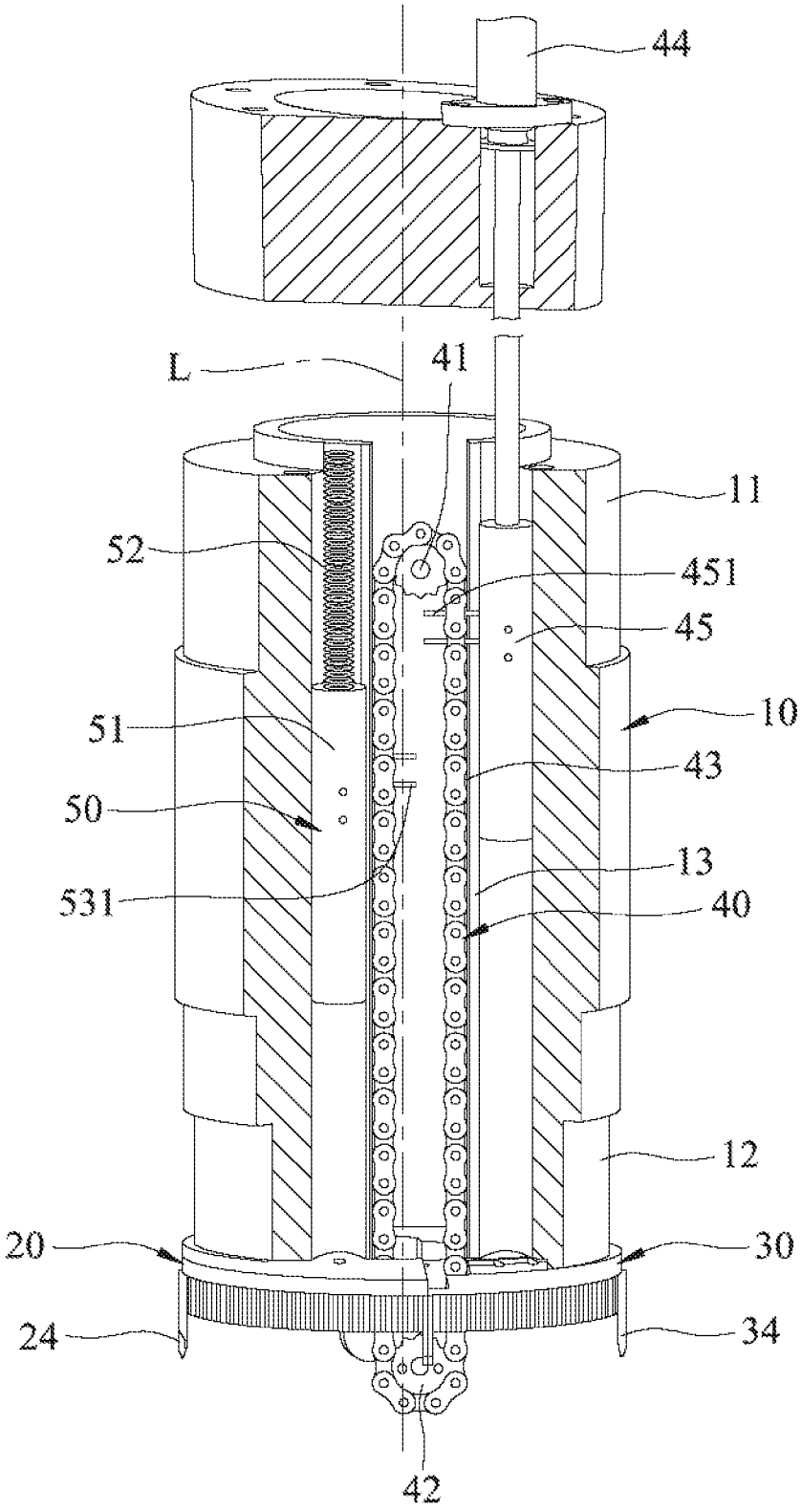
FIG. 4 is a partly sectional view of the stitching device of the apparatus of the preferred embodiment.
Figure 5:
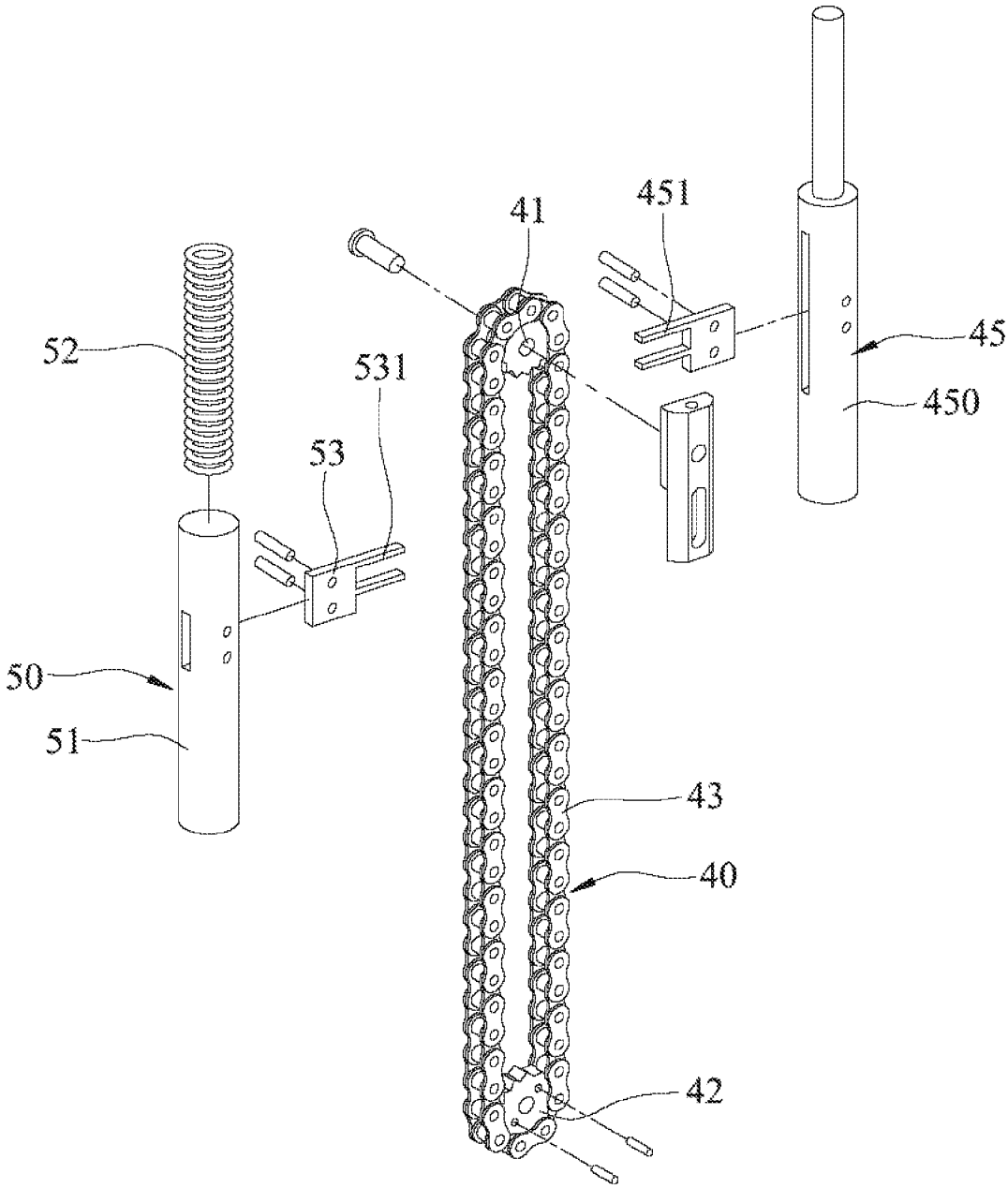
FIG. 5 is an exploded perspective view of a main drive assembly and an auxiliary drive assembly of the stitching device.
Figure 6:
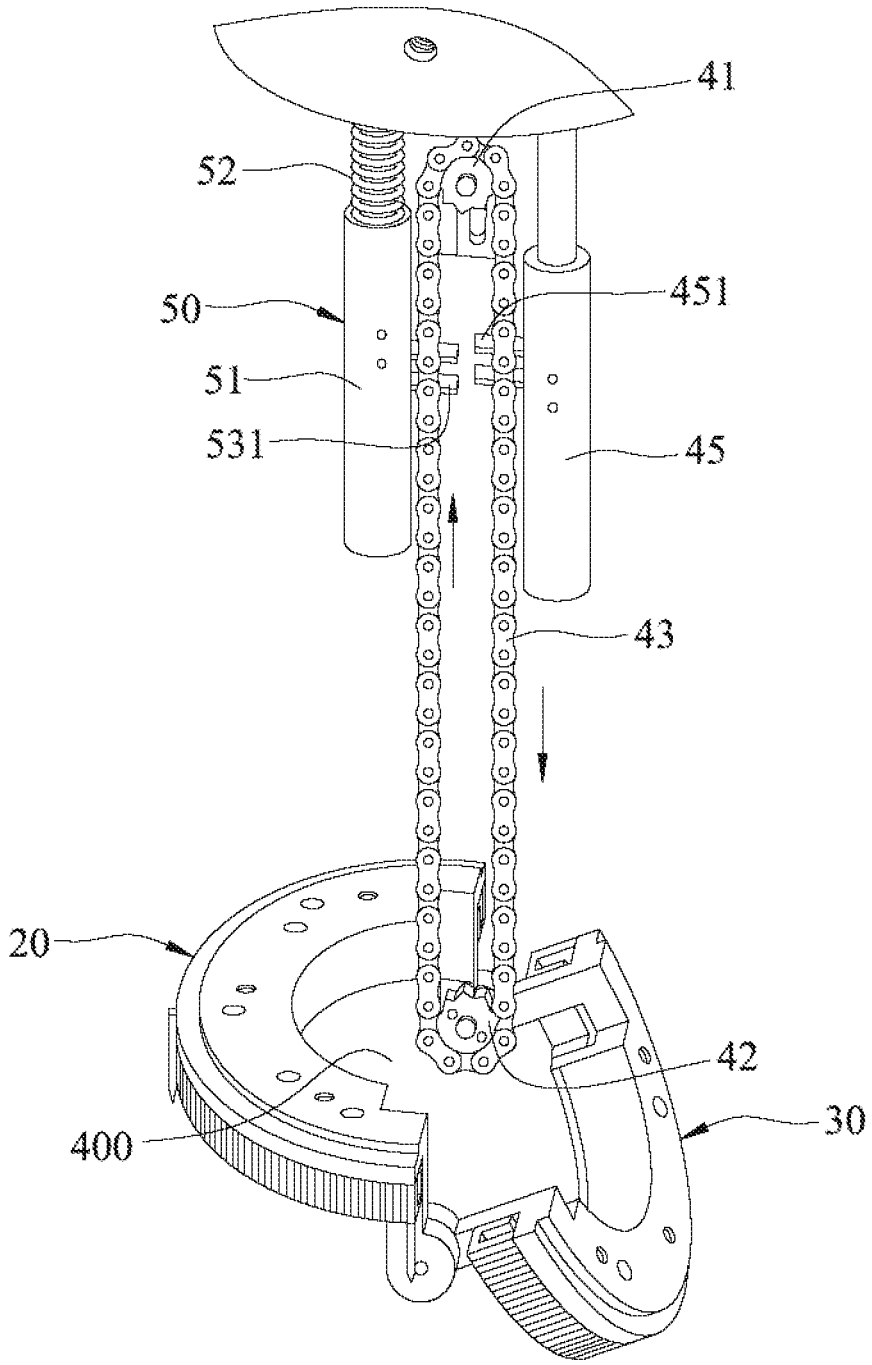
FIG. 6 is a fragmentary perspective view of the stitching device, illustrating how the main drive assembly drives a movable reed to rotate relative to a fixed reed.
Figure 17:
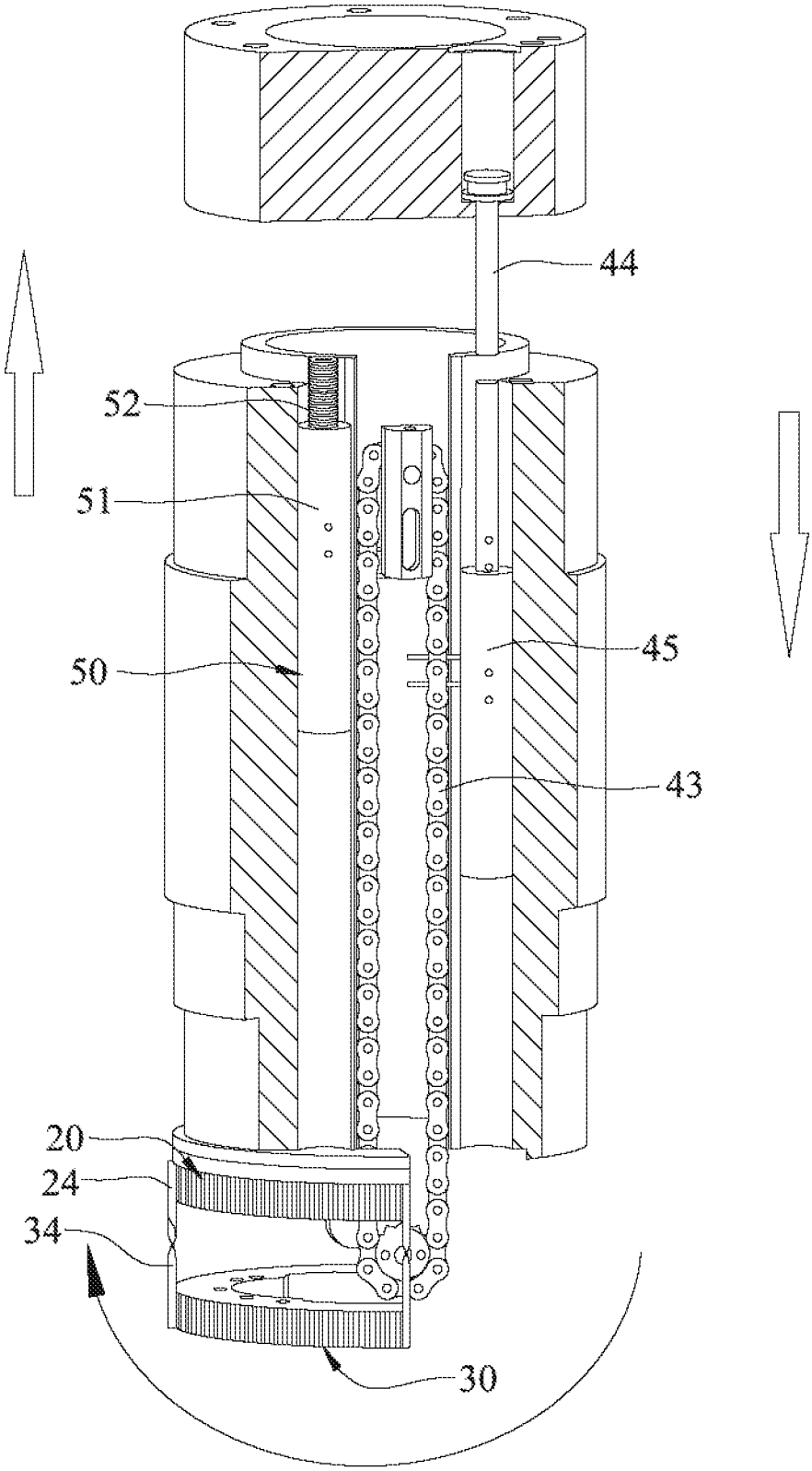
FIG. 17 is a view similar to FIG. 4, but with the movable reed being pivoted to a position below the fixed reed.

The main drive assembly 40 includes a first rotary wheel 41 pivoted to the main body 10 within the accommodating space 13 and in proximity to the top end 11, a second rotary wheel 42 fixed to one of the second pivot lugs 33, a flexible member 43 looped around the first and second rotary wheels 41, 42, a main drive member 44 (see FIG. 4) disposed above the main body 10 and driving movement of the flexible member 43 along an axial direction that is parallel to the longitudinal axis (L), and a connecting member 45 that is disposed axially and slidably in the main body 10, that is connected to the flexible member 43 and that is driven by the main drive member 44 to push the flexible member 43 to move along the axial direction. The movable reed 30 is driven by the main drive member 44 to move between a juxtaposed position, as shown in FIG. 4, and a stacked position, as shown in FIG. 17. In the juxtaposed position, the movable reed 30 is disposed side by side with the fixed reed 20 in a same plane. In the stacked position, the movable reed 30 is stacked below the fixed reed 20. The first and second inner surfaces 21, 31 cooperatively define a central hole (400) that communicates with the accommodating space 13 when the movable reed 300 is in the juxtaposed position. When the movable reed 30 is pivoted relative to the fixed reed 20 to the stacked position, the second reed teeth 34 respectively mate with the first reed teeth 24 (see FIGS. 15 to 17) along the axial direction.

In this embodiment, each of the first and second rotary wheels 41, 42 is a sprocket wheel, the flexible member 43 is a roller chain, and the main drive member 44 is a pressure cylinder that includes a cylinder body 441 fixed on a top seat 75 (see FIGS. 3 and 14), and a piston rod 442 retractably protruding from the cylinder body 441. The connecting member 45 includes an elongated main rod 450 disposed slidably in the main body 10, and a fork rod 451 connected to the main rod 450 and having a pair of prongs 4511 each inserted into two adjacent ones of rollers of the flexible member or roller chain 43. The piston rod 442 contacts a top end of the main rod 450 to push downward the main rod 450 when the main drive member 44 is actuated. The main drive assembly 40 further includes a sensor 46 (see FIG. 3) mounted on a support frame 70. The sensor 46 detects actuation of the main drive member 44, so that when the movable reed 30 is rotated relative to the fixed reed 20 to the stacked position, the sewing needle 101 can then be executed to perform a sewing operation according to a control process.

The auxiliary drive assembly 50 includes an elongated pushing member 51 disposed axially and slidably in the main body 10, a biasing member 52 abutting between the main body 10 and the pushing member 51 and biasing the pushing member 51 to move downward, and an auxiliary fork rod 53 connected between the pushing member 51 and the flexible member 43. The biasing member 52 is a compression spring that provides a biasing force to move the movable reed 30 from the stacked position to the juxtaposed position. The auxiliary fork rod 53 has a pair of prongs 531 each inserted into two adjacent ones of rollers of the roller chain 43. The connecting member 45 and the pushing member 51 are disposed on two opposite sides of the flexible member or roller chain 43.

As shown in FIG. 1, the transfer unit 2 is used for transferring the toe end of the hosiery body 300 from the knitting machine 200 to the stitching device 1 (see FIG. 2) and positioning the toe end on the fixed and movable reeds 20, 30. The transfer unit 2 includes a plurality of transfer members 61, and a plurality of strip members 62 respectively disposed below the transfer members 61. The transfer members 61 and the strip members 62 are movable relative to the first and second reed teeth 24, 34 in a direction that is parallel to the longitudinal axis and a direction that is perpendicular to the longitudinal axis. Each transfer member 61 has a pointed end portion 611 (see FIG. 10) slidable in a corresponding one of the first and second reed teeth 24, 34. Each strip member 62 has a fork end portion 621 inserted into the pointed end portion 611 such that two prongs of the fork end portion 621 are disposed on two opposite sides of the pointed end portion 611. Since the technical means and coordination among the components of the transfer unit are disclosed in Taiwanese Patent Publication No. 201144506, a detailed description thereof is dispensed herewith.

Figure 2:
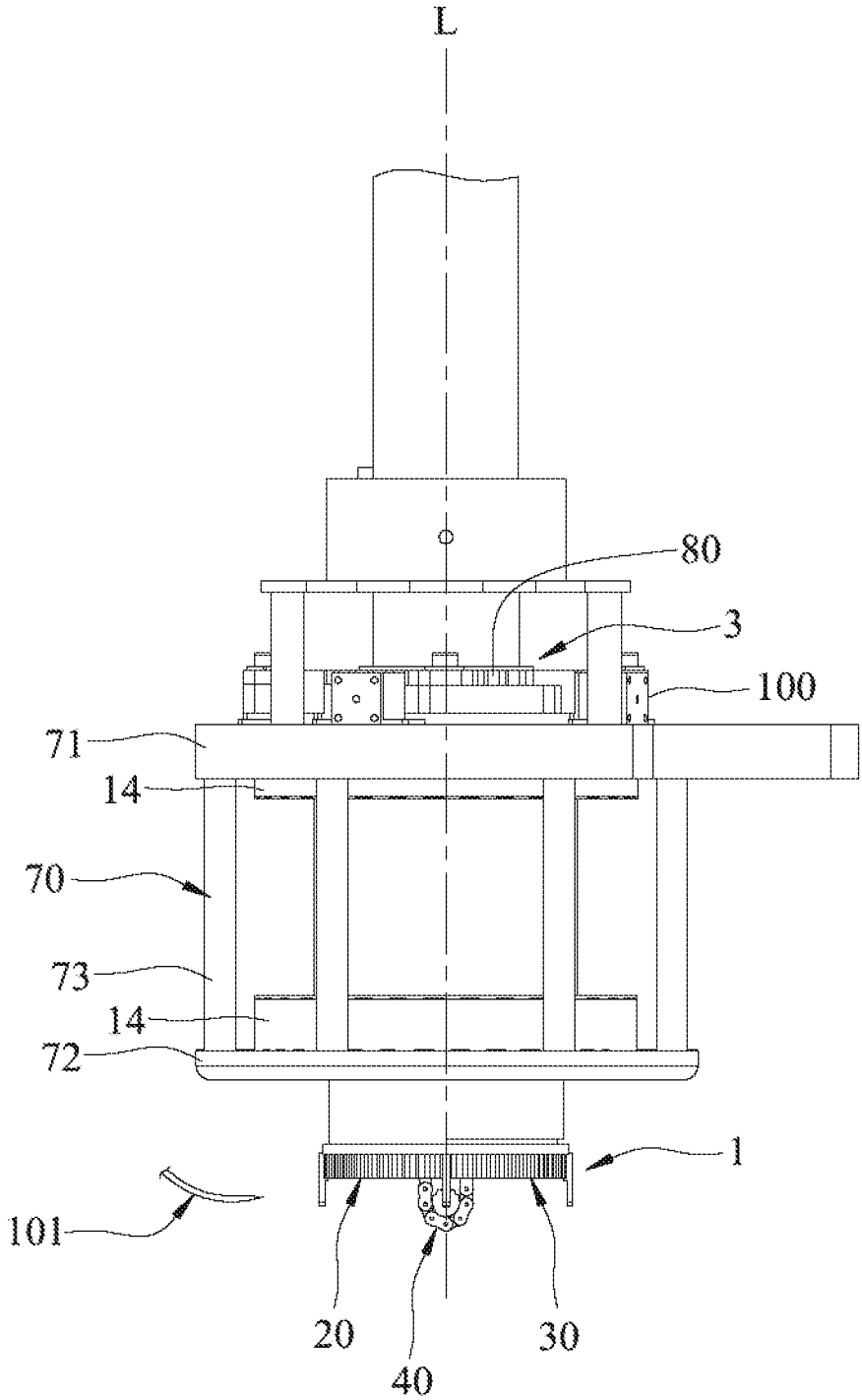
FIG. 2 is a schematic view of a stitching device and a rotary control unit of the apparatus of the preferred embodiment.
Figure 3:
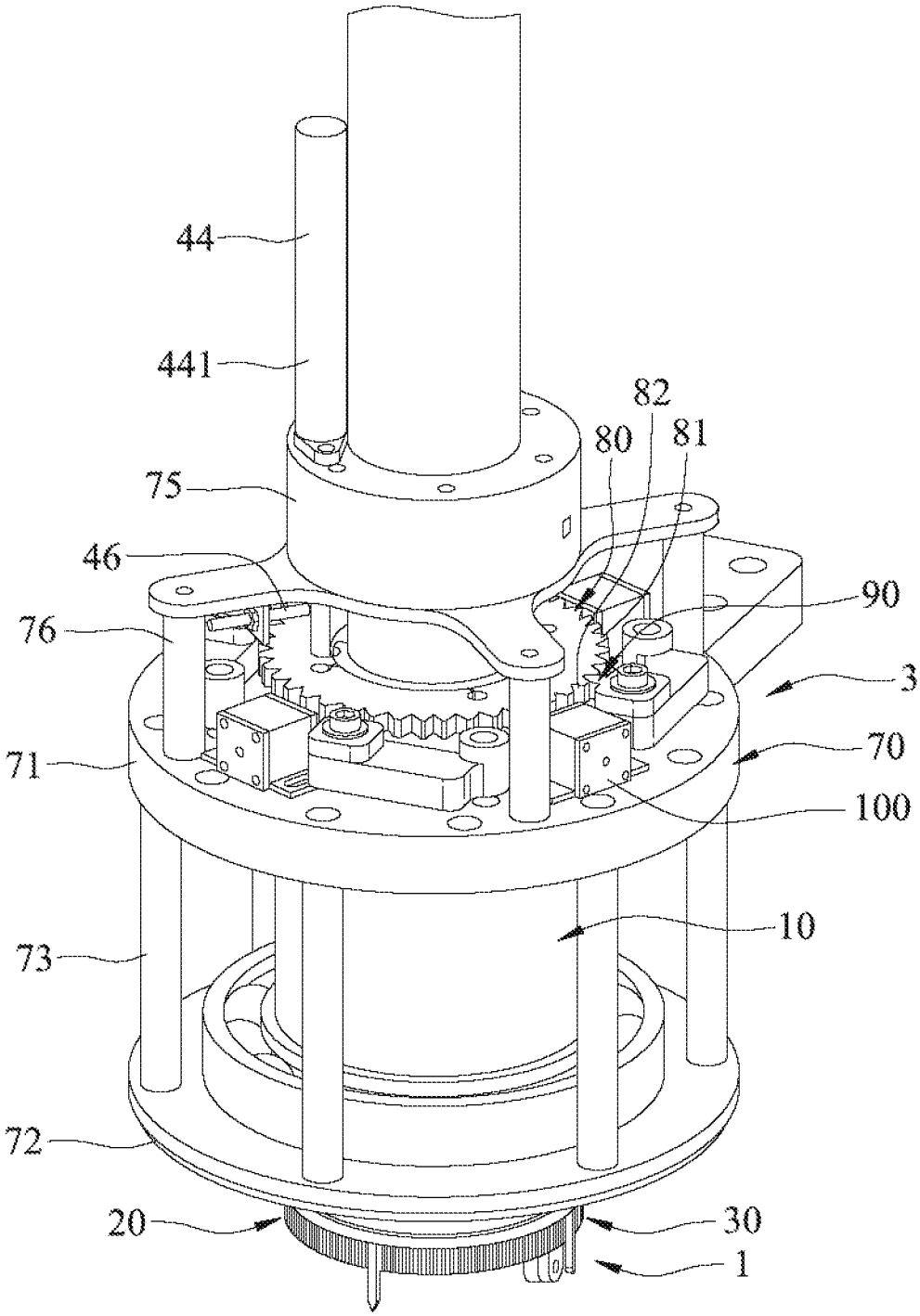
FIG. 3 is a perspective view of the stitching device and the rotary control unit of the apparatus of the preferred embodiment.
Figure 8:
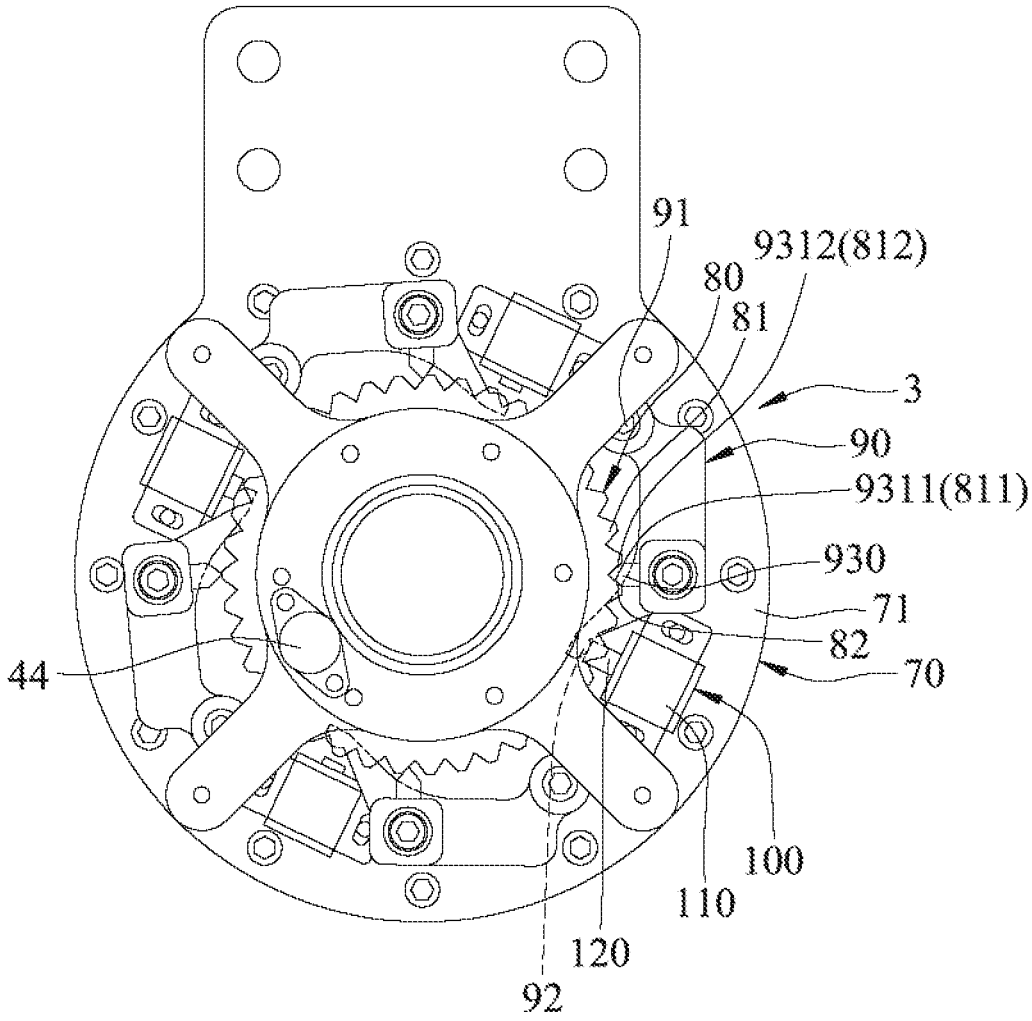
FIG. 8 is a schematic top view of the rotary control unit.
Figure 9:
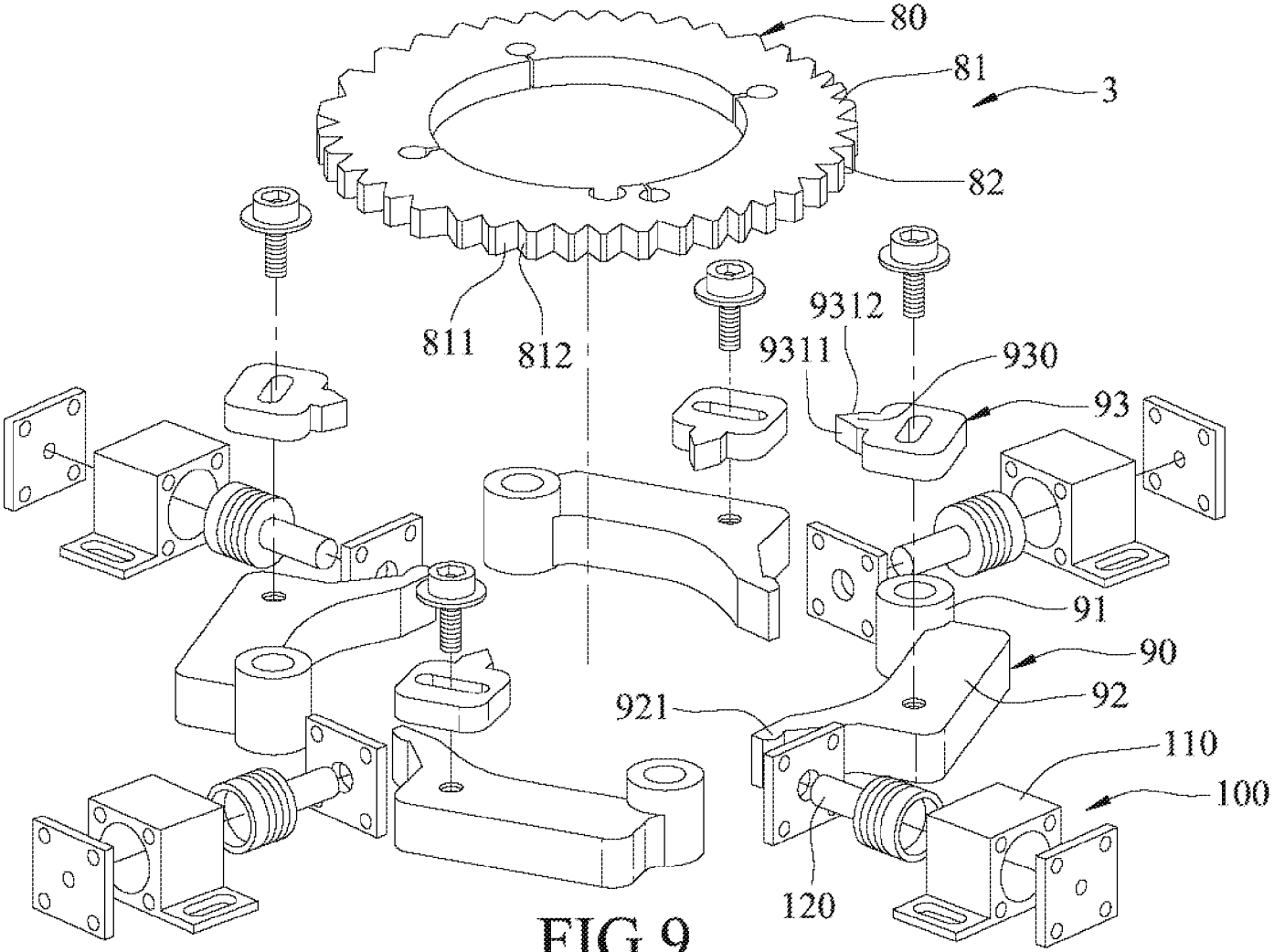
FIG. 9 is an exploded perspective view of the rotary control unit.

With reference to FIGS. 3, 8 and 9, in combination with FIGS. 2 and 3, the rotary control unit 3 includes a support frame 70 supporting the main body 10, a rotary disc 80 attached to the top end 11 of the main body 10, a plurality of angularly spaced-apart detent members 90 pivoted to the support frame 70 and disposed around the rotary disc 80, and a plurality of control drive members 100 respectively driving the detent members 90.

The support frame 70 includes an upper support plate 71 facing the rotary disc 80, a lower support plate 72 and a plurality of spaced-apart connecting rods 73 interconnecting the upper and lower support plates 71, 72. A portion of the main body 10 that is proximate to the top end 11 and a portion of the main body 10 that is proximate to the bottom end 12 are respectively disposed on the upper and lower support plates 71, 72 by using bearings 14 (see FIG. 2). The top seat 75 is supported above the upper support plate 71 by a frame 76 (see FIG. 3). The rotary disc 80 has a plurality of angularly spaced-apart engaging elements 81 and a plurality of V-shaped grooves 82. The engaging elements 81 are configured as teeth, each of which tapers radially and outwardly from a periphery thereof. Each of the V-shaped grooves 82 is formed between two adjacent ones of the engaging elements or teeth 81 and is defined by two opposite inclined leading and trailing groove walls 811, 812. When the control drive members 100 are consecutively operated, each detent member 90 is actuated by a respective control drive member 100 to drive a limited amount of rotation of the rotary disc 80. The engaging elements 81 move past the detent members 90 when the rotary disc 80 is rotated. Each detent member 90 cams one of the engaging elements 81 that is closed thereto so as to drive the limited amount of rotation of the rotary disc 80 when actuated by the respective control drive member 100. The control drive members 100 consecutively operate to consecutively actuate the respective detent members 90 such that the rotary disc 80 together with the stitching device 1 consecutively produces a limited amount of rotation in an intermittent manner. In this embodiment, the number of the engaging element or tooth $1 formed on the periphery of the rotary disc 80 is 39.

Each of the detent members 90 includes a pivot end 91 pivoted to the upper support plate 71, a movable portion 92 connected to the pivot end 91 and having a free end 921 opposite to the pivot end 91, and a detent portion 93 screwed on the movable portion 92 and located between the pivot end 91 and the free end 921. The detent portion 93 includes a projection 930 extendable into each of the grooves 82. The projection 930 has a shape complementing with that of each of the grooves 82, and includes two opposite inclined leading and trailing detent surfaces 9311, 9312. The inclined leading and trailing detent surfaces 9311, 9312 respectively contact the inclined leading and trailing groove walls 811, 812 when the projection 930 extends into one of the grooves 82.

Each of the control drive members 100 is a pressure cylinder, and includes a cylinder body 110 fixed on the upper support plate 71, and a piston rod 120 retractably protruding from the cylinder body 110 and alignable with the free end 921 of the movable portion 92 of the respective detent member 90.

Figure 10:
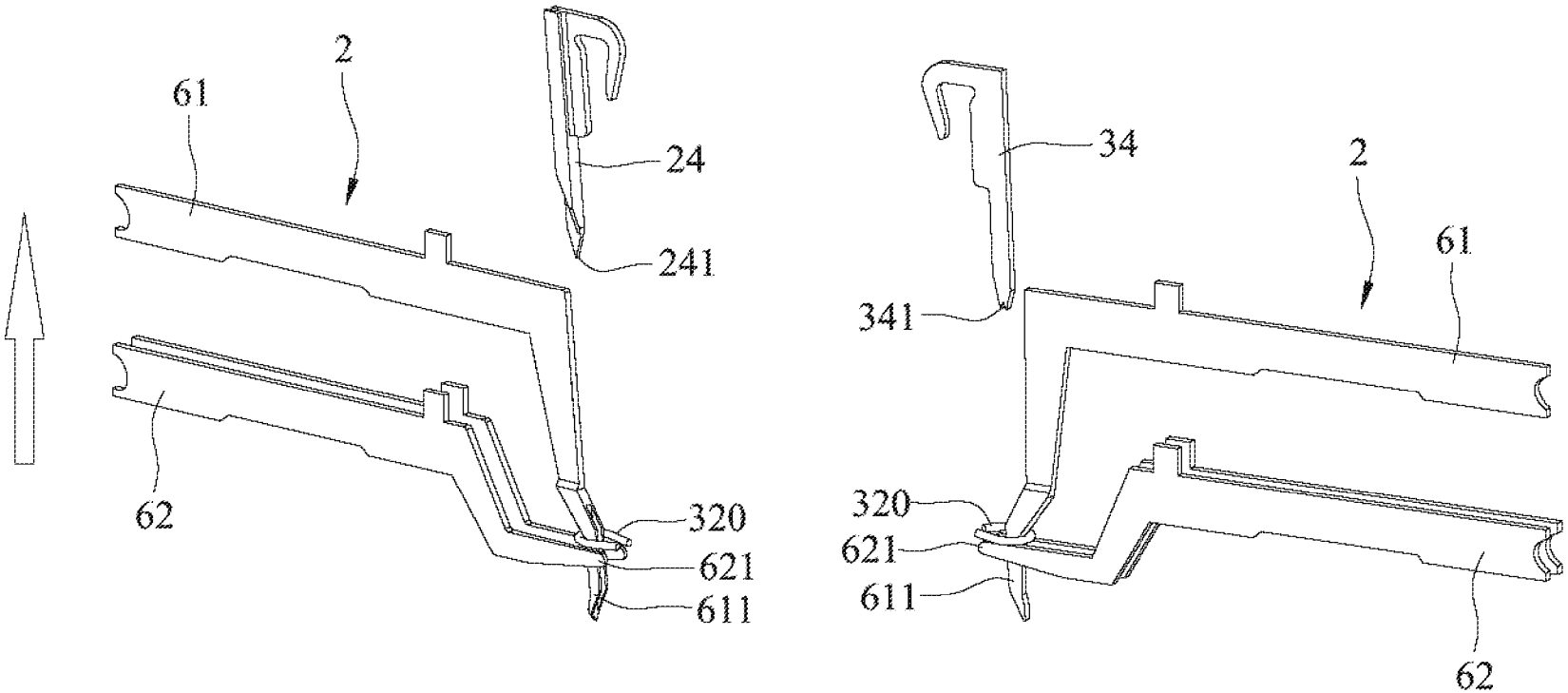
FIG. 10 illustrates how loops are transferred by transfer members and strip members of the transfer unit.

With reference to FIG. 10, in this embodiment, the total number of the transfer members 61 and the strip members 62 of the transfer unit 2 corresponds to the number of the knitting needles 210 of the knitting machine 200. The number of the knitting needles 210 is 156. The number of each of the transfer members 61 and the strip members 62 is 78. For convenience of explanation, only two of each of the transfer members 61 and the strip members 62 will be described herein. When 156 pieces of loops 320 around a periphery of the toe end 310 of the hosiery body 300 are transferred from the knitting needles 210 of the knitting machine 200 to the transfer and strip members 61, 62 (i.e., the loops 320 are respectively sleeved on the pointed end portions 611 of the transfer members 61 and are positioned thereto by the fork end portions 621 of the respective strip members 62), the transfer unit 2 can then transfer the loops 320 below the stitching device 1. At this time, as shown in FIGS. 2, 4 and 10, the movable reed 30 is in the juxtaposed position.

Figure 11:
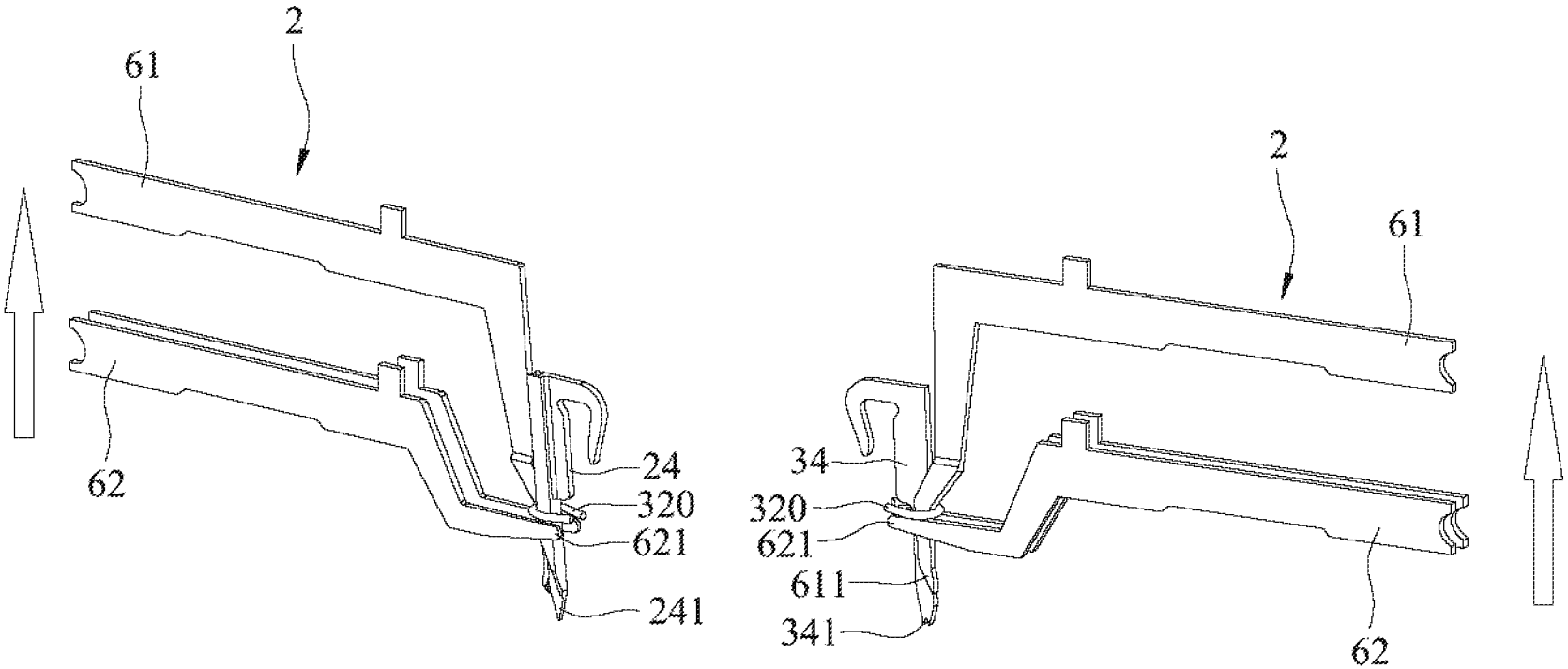
FIG. 11 illustrates how the transfer and strip members transfer the loops to a first reed tooth of the fixed reed and a second reed tooth of the movable reed.

With reference to FIG. 11, the transfer and strip members 61, 62 are moved upwardly until the loops 320 are respectively sleeved on the first and second reed teeth 24, 34.

Figure 12:
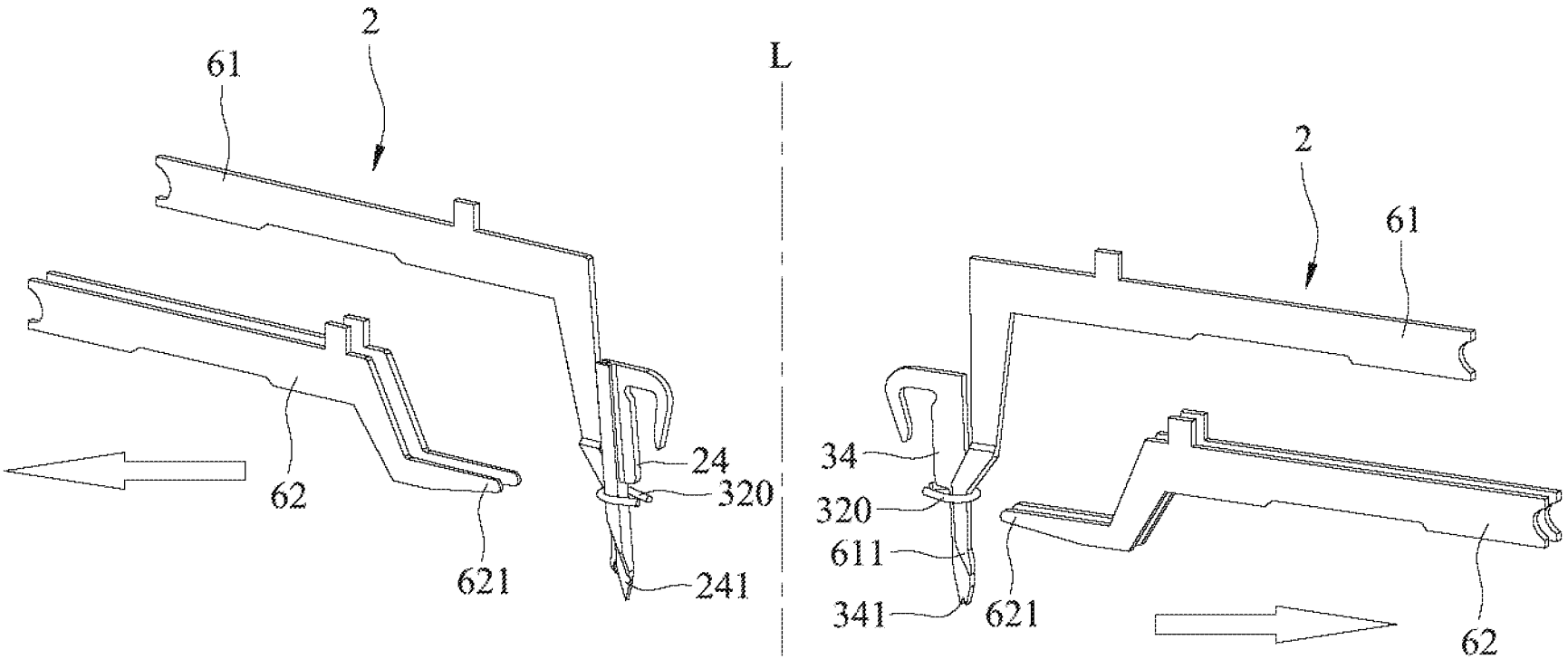
FIG. 12 illustrates the strip members being moved away from the fixed and movable reeds in arrow directions.
Figure 13:
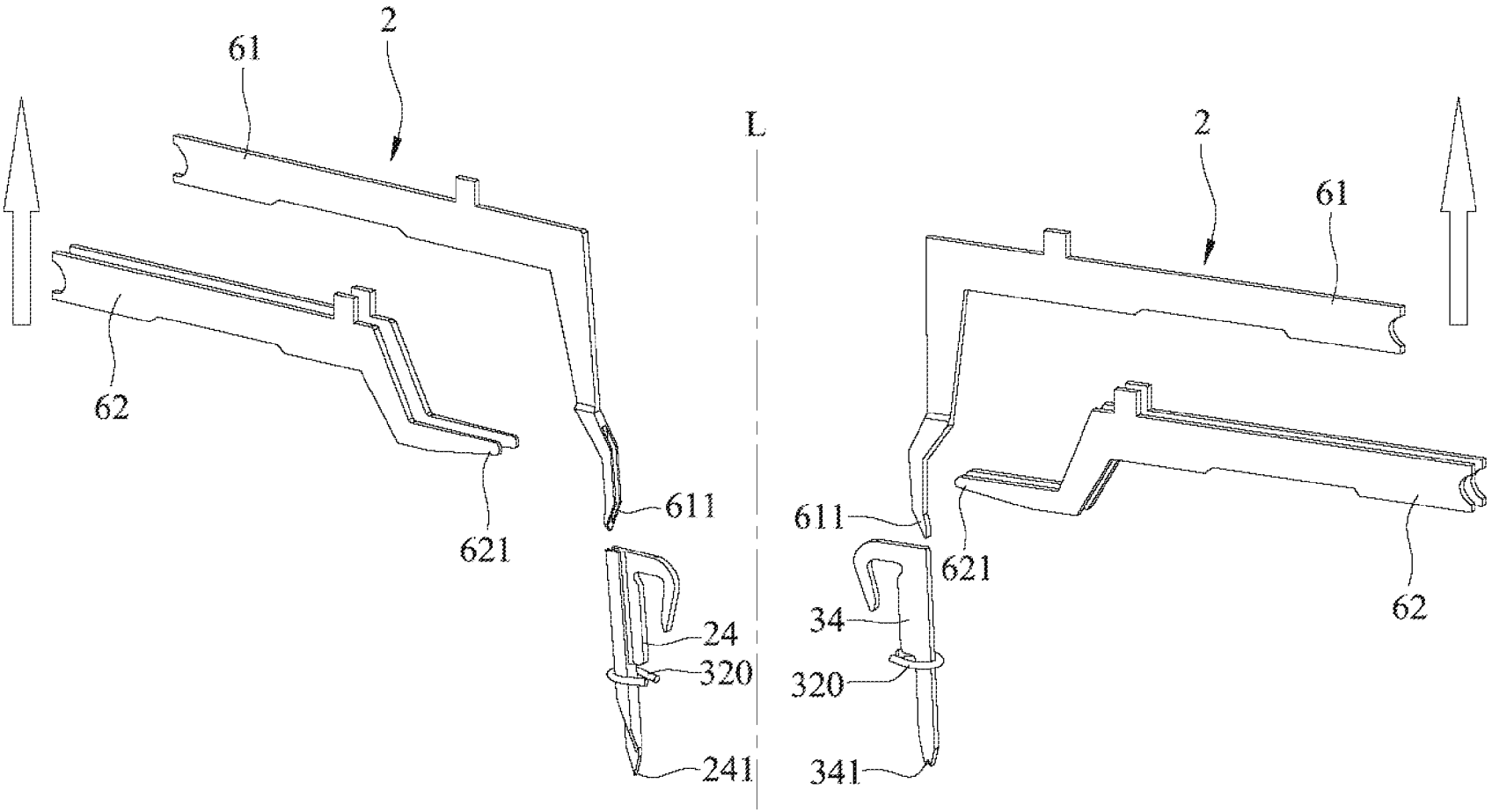
FIG. 13 illustrates the transfer and strip members being moved upward and away from the fixed and movable reeds.
Figure 14:
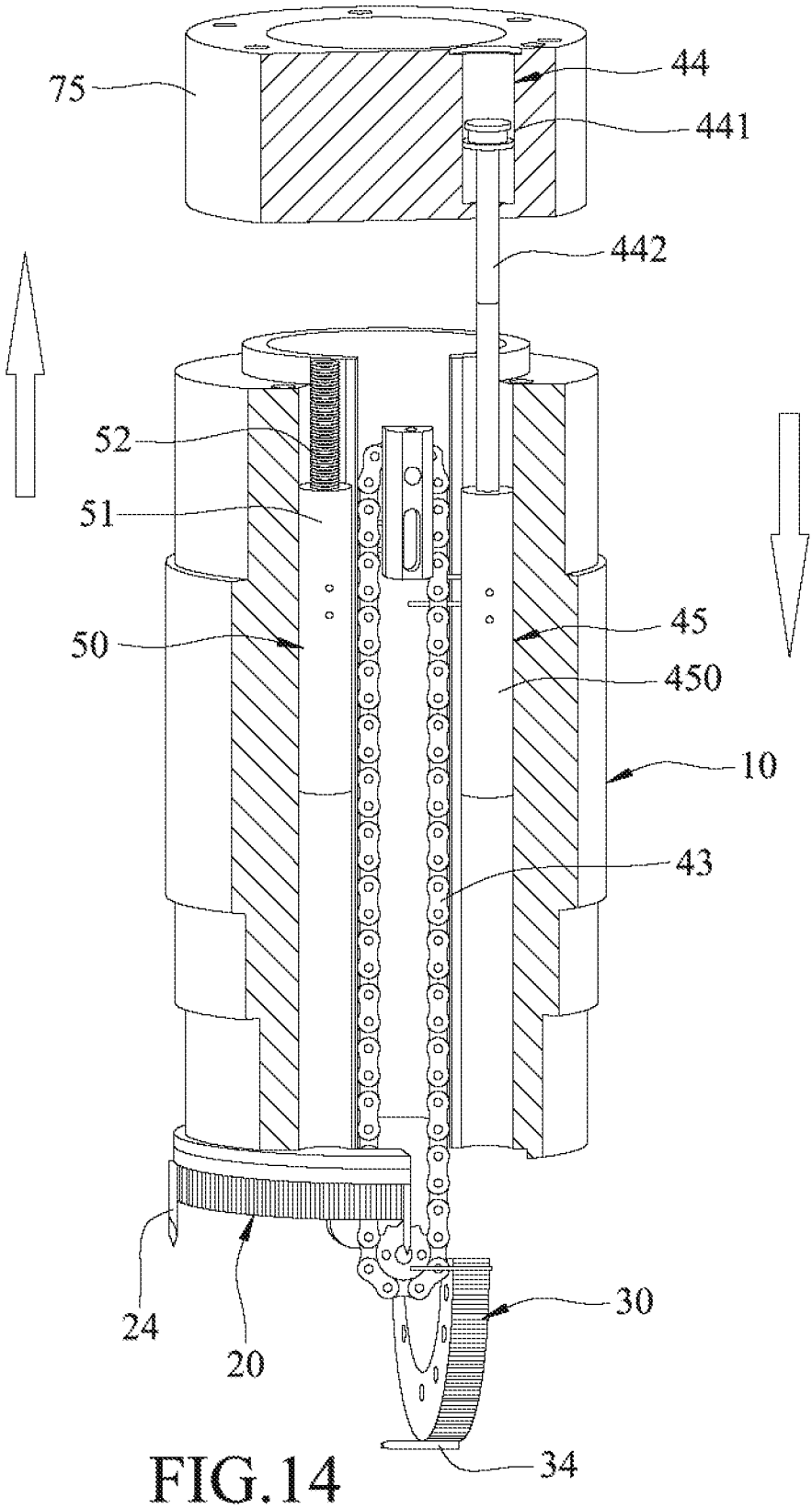
FIG. 14 is a view similar to FIG. 4, but with the movable reed in a state of operation.
Figure 16:
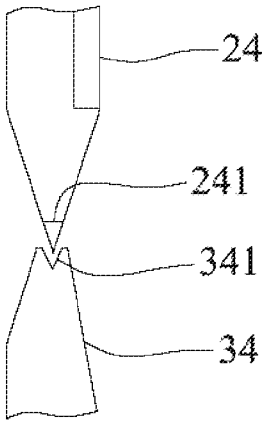
FIG. 16 is an enlarged fragmentary schematic view of FIG. 15, illustrating how the second reed tooth mates with the first reed tooth.
Figure 15:
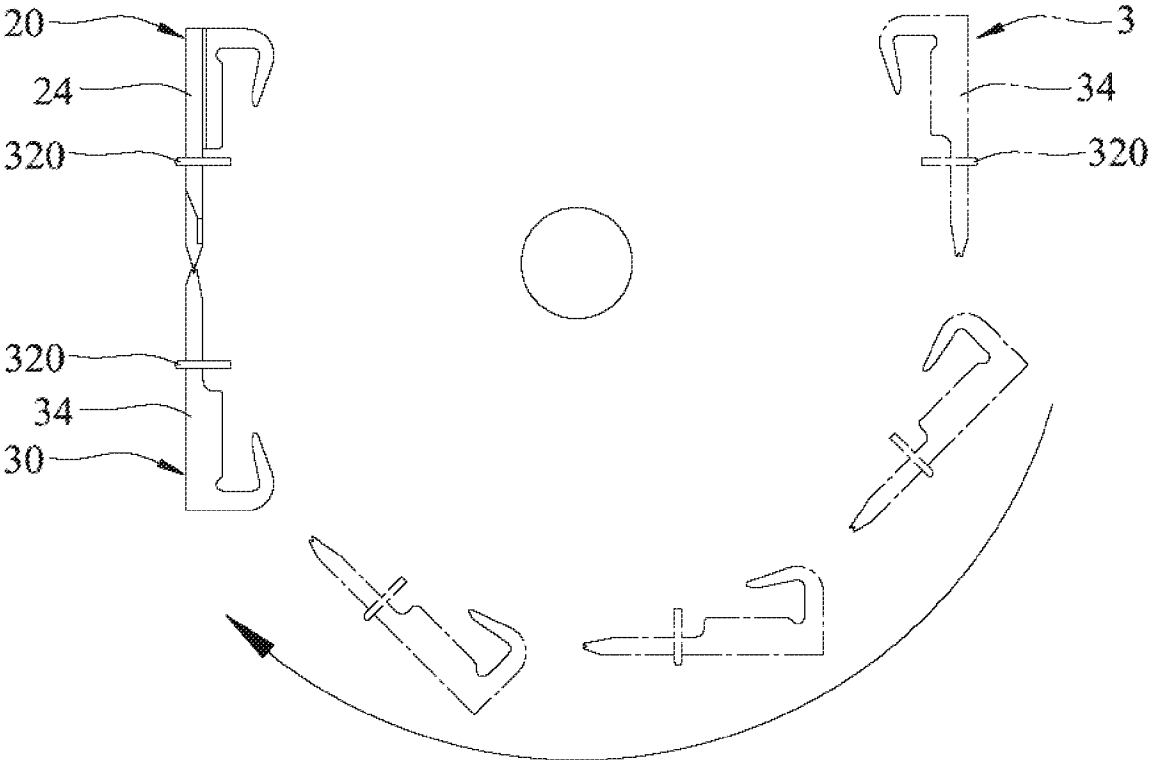
FIG. 15 is a schematic view, illustrating how the movable reed operates.

With reference to FIG. 12, the strip members 62 are first moved away from the first and second reed teeth 24, 34 in a direction that is perpendicular to the longitudinal axis (L), and then, as shown in FIG. 13, the transfer and strip members 61, 62 are simultaneously moved upward along the longitudinal axis (L) and away from the first and second reed teeth 24, 34, thereby moving the transfer unit 2 away from the loops 320 and from the fixed and movable reeds 20, 30. At this time, the loops 320 are smoothly transfer to the first and second reed teeth 24, 34.

With reference to FIGS. 5 and 14 to 16, when the main drive member 44 is actuated, the piston rod 442 pushes the top end of the connecting member 45 so as to move the connecting member 45 downwardly. The fork rod 451 of the connecting member 45, in turn, pushes the flexible member or roller chain 43 to rotate in a clockwise direction. That is, a right side of the roller chain 43 is pushed by the fork rod 451 to move downwardly, while a left side thereof moves upwardly. The pushing member 51 is pushed by the right side of the roller chain 43 to move upwardly, and the biasing member or compression spring 52 is compressed to store a restoring force. Further, the movable reed 30 is also driven to move relative to the fixed reed 20 from the juxtaposed position shown in FIG. 4 to the stacked position shown in FIG. 17. At this time, the female reed tooth 34 mates with the male reed tooth 24.

Figure 18:
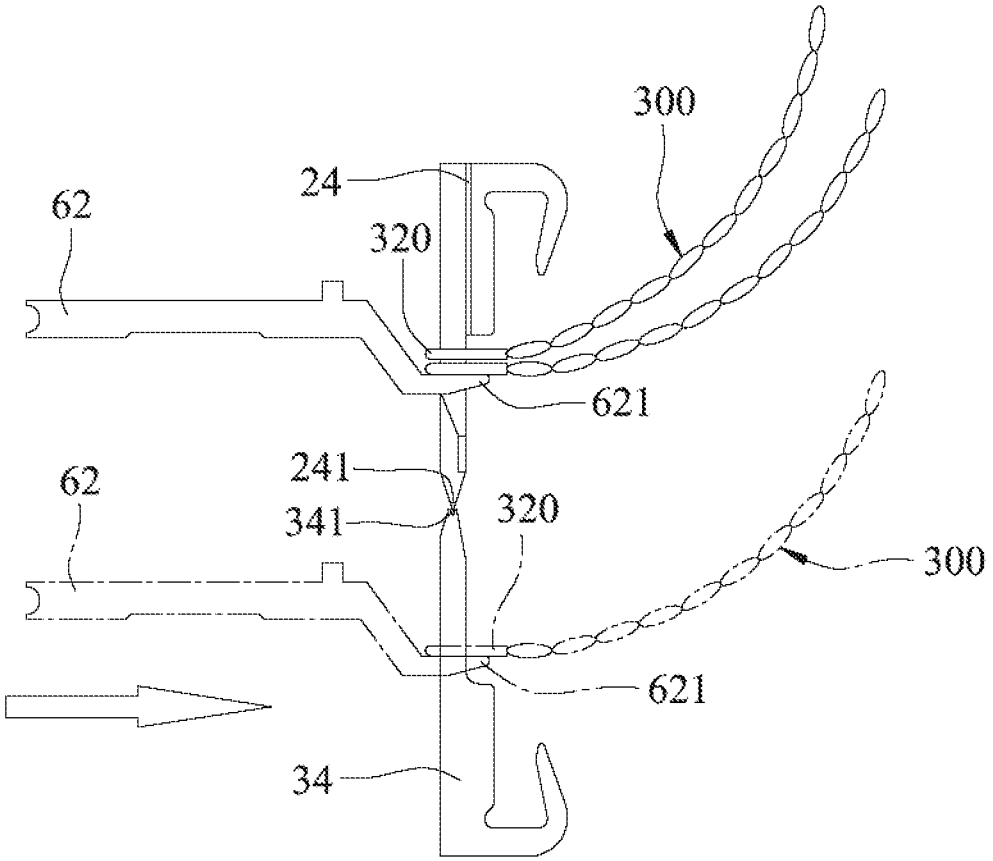
FIG. 18 illustrates how the strip member is moved upward to push the loop that is sleeved on the second reed tooth toward the loop that is sleeved on the first reed tooth.

As shown in phantom lines in FIG. 18, the strip member 62 is operated to move toward the second reed tooth 34 such that the fork end portion 621 is disposed below the loop 320 that is sleeved on the second reed tooth 34. As shown in solid lines in FIG. 18, the strip member 62 is then moved upward so that the fork end portion 621 can push the loop 320 on the second reed tooth 34 toward the loop 320 on the first reed tooth 24.

Afterwards, the main drive member 44 is again actuated to retract the piston rod 442. Through the restoring force of the biasing member 52 that pushes the pushing member 51 to move downward, the pushing member 51, in turn, pushes the left side of the roller chain 43 to move downward until the movable reed 30 is pivoted relative to the fixed reed from the stacked position shown in FIG. 17 back to the juxtaposed position shown in FIG. 4. Simultaneously, the fork rod 451 of the connecting member 45 pushes the right side of the roller chain 43 to move upward so that the roller chain 43 rotates in a counterclockwise direction. That is, the right side of the roller chain 43 moves upwardly, while the left side thereof moves downwardly.

Figure 19:
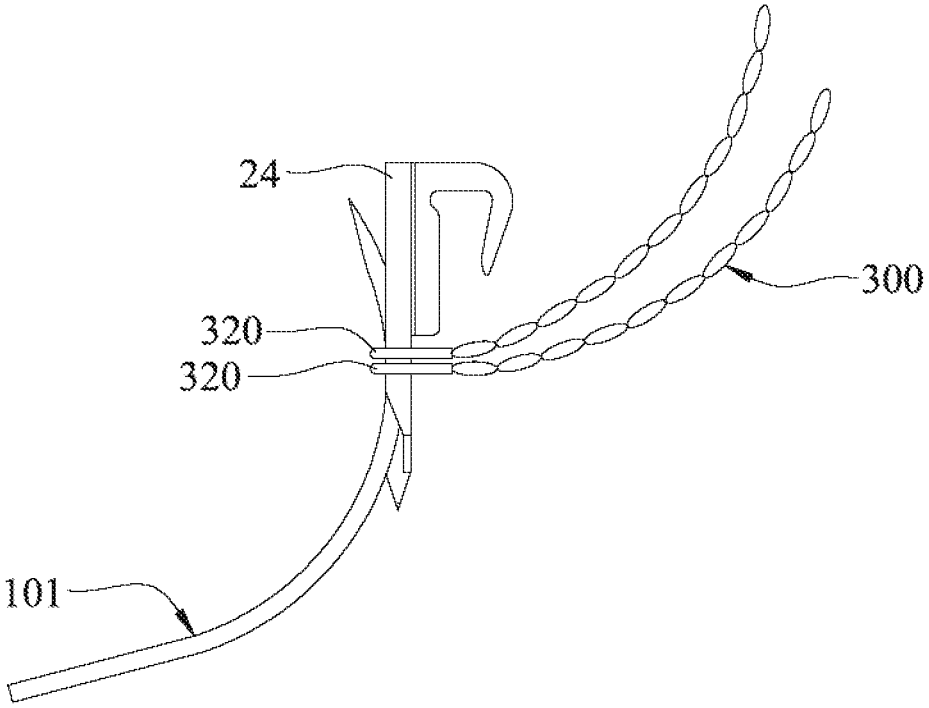
FIG. 19 illustrates a sewing needle in a stitching operation.

When the sensor 46 detects that the operation of the main drive member 44 is completed, that is, the loop 320 on the second reed tooth 34 is already transferred to and is disposed adjacently below the loop 320 which is on the first reed tooth 24, the sewing needle 101 is actuated to execute a sewing operation according to a control process. With reference to FIG. 19, the sewing needle 101 is disposed in a specific location, and starts to stitch together the two loops 320 on the first reed tooth 24.

Figure 20:
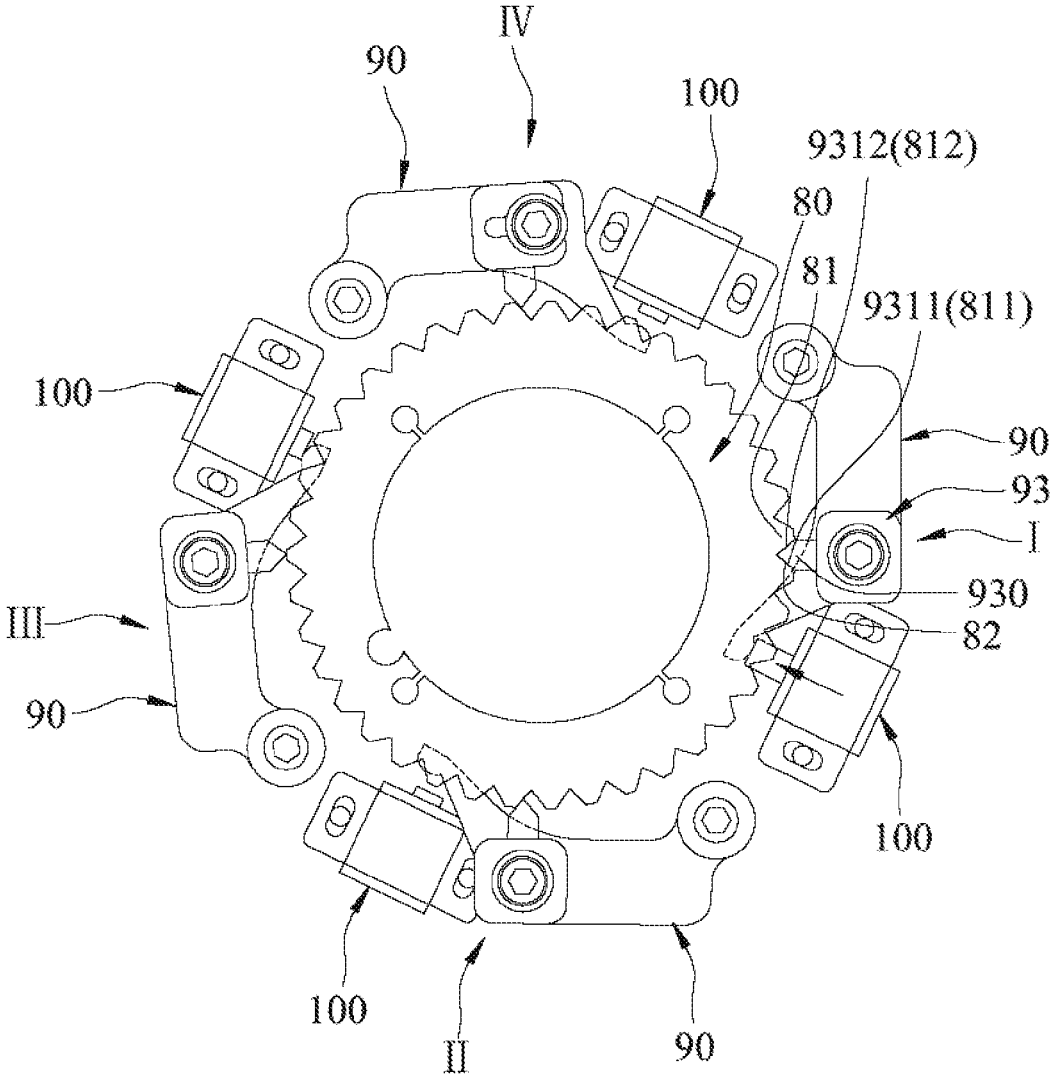
FIG. 20 is a schematic top view of the rotary control unit, illustrating a projection of a detent member of a first workstation extending into one of the grooves in a rotary disc.

The stitching operation of the sewing needle 101 can coordinate with the intermittent operation of the rotary control unit 3 to achieve the purpose of continuous stitching. As shown in FIG. 20, the apparatus further comprises a plurality of workstations around the rotary disc 90. In this embodiment, four workstations are exemplified. The first to fourth workstations (I, II, III, IV) are angularly spaced apart from each other. Each of the first to fourth workstations (I, II, III, IV) is provided with one of the detent members 90 and one of the control drive members 100. When the control drive member 100 at the first workstation (I) is initially operated, the detent portion 93 of the detent member 90 is pushed by the piston rod 120 (see FIG. 9) of the control drive member 100 to move toward the rotary disc 80 until the projection 930 thereof extends into one of the grooves 82 with the inclined leading detent surface 9311 of the projection 930 pushing the inclined leading groove wall 811 of the one of the grooves 82. This results in driving a limited amount of rotation of the rotary disc 80. In this embodiment, the rotary disc 80 is rotated by an angle of about 2.3° (which is the included angle between each two adjacent ones of the first or second reed teeth 24, 34 and which is obtained by dividing 180° over 78 first or second reed teeth=2.3°). Further, the control drive members 100 at the second to fourth workstations (II, III, IV) will not produce operation when the control drive member 100 at the first workstation (I) is actuated. At this time, the inclined leading and trailing detent surfaces 9311, 9312 of the projection 930 execute a detent action against the inclined leading and trailing groove walls 811, 812 of the one of the grooves 82. With the projection 930 of the detent portion 93 at the first workstation (I) extending into the one of the grooves 82, the rotary disc 80 and the stitching device 1 are locked, so that the sewing needle 101 can accurately execute a stitching operation.

Figure 21:
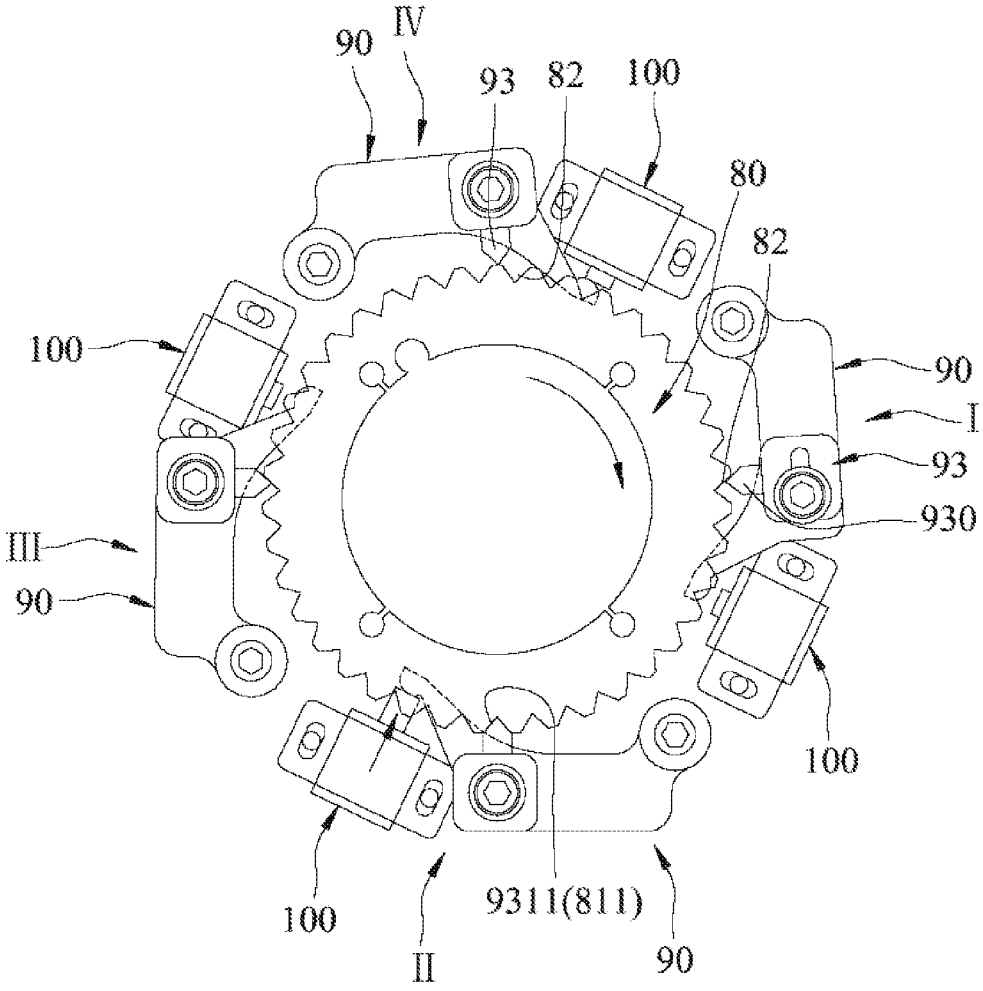
FIG. 21 is a view similar to FIG. 20, but illustrating a projection of a detent member of a second workstation extending into one of the grooves in the rotary disc.

As shown in FIG. 21, when the control drive member 100 at the second workstation (II) is operated, the detent portion 93 of the detent member 90 is pushed by the piston rod 120 of the control drive member 100 to move toward the rotary disc 80 until the projection 930 thereof extends into one of the grooves 82 with the inclined leading detent surface 9311 of the projection 930 pushing the inclined leading groove wall 811 of the one of the grooves 82. This results in driving the rotary disc 80 to rotate by an angle of about 2.3° in a clockwise direction. Further, the control drive members 100 at the third and fourth workstations (II, IV) will not produce operation. The rotary disc 80 and the stitching device 1 will again be locked, so that the sewing needle 101 can accurately execute the stitching operation. Through the limited amount of rotation of the rotary disc 80, the projection 930 of the detent member 90 at the first workstation (I) is moved slightly outward but with the inclined trailing detent surface 9312 still in contact with the inclined trailing groove wall 812 of the one of the grooves 82.

Figure 22:
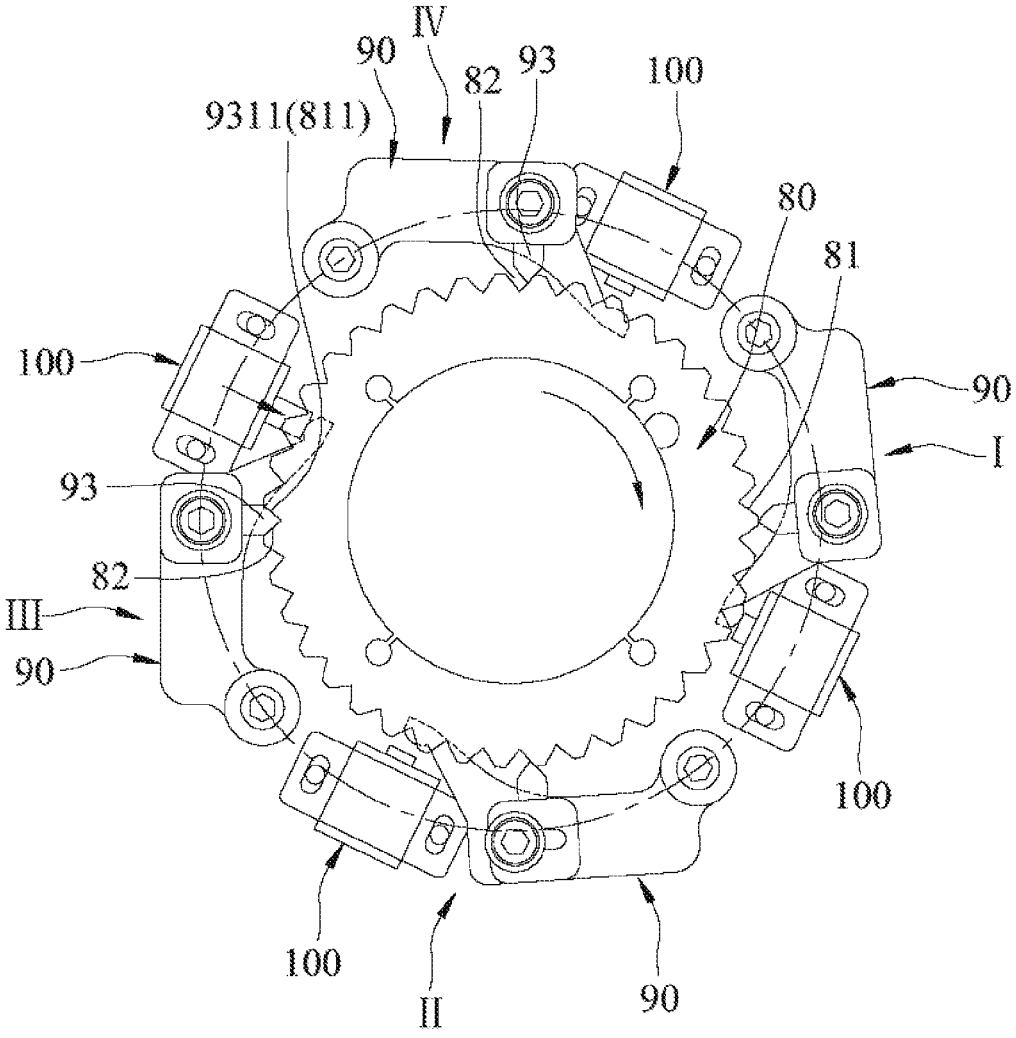
FIG. 22 is a view similar to FIG. 20, but illustrating a projection of a detent member of a third workstation extending into one of the grooves in the rotary disc.

With reference to FIG. 22, when the control drive member 100 at the third workstation (III) is operated, the detent portion 93 of the detent member 90 is pushed by the piston rod 120 of the control drive member 100 to move toward the rotary disc 80 until the projection 930 thereof extends into one of the grooves 82 with the inclined leading detent surface 9311 of the projection 930 pushing the inclined leading groove wall 811 of the one of the grooves 82. This results in driving the rotary disc 80 to rotate by an angle of about 2.3° in the clockwise direction. At this time, the control drive members 100 at the first, second and fourth workstations (I, II, IV) will not produce operation. The rotary disc 80 and the stitching device 1 will again be locked, so that the sewing needle 101 can accurately execute the stitching operation. Through rotation of the rotary disc 80, the projection 930 of the detent member 90 at the first workstation (I) will move further outward but with a tip thereof in contact a tip of the engaging tooth 81, while the projection 930 of the detent member 90 at the second workstation (II) will move outward but with the inclined trailing detent surface 9312 still in contact with the inclined trailing groove wall 812 of the one of the grooves 92.

Figure 23:
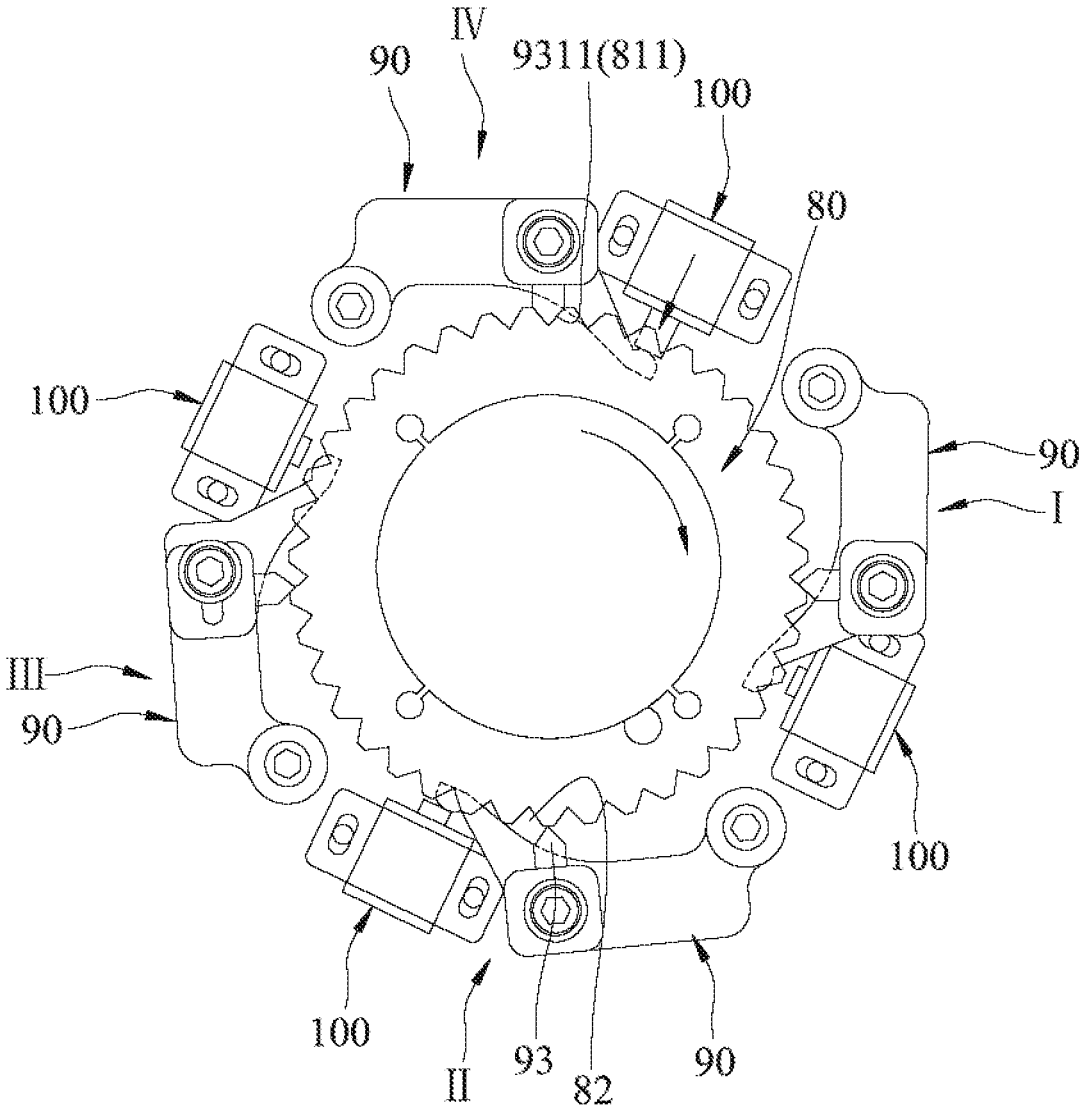
FIG. 23 is a view similar to FIG. 20, but illustrating a projection of a detent member of a fourth workstation extending into one of the grooves in the rotary disc.

With reference to FIG. 23, when the control drive member 100 at the fourth workstation (IV) is actuated, the detent portion 93 of the detent member 90 is pushed by the piston rod 120 to move toward the rotary disc 80 until the projection 930 thereof extends into one of the grooves 82 with the inclined leading detent surface 9311 of the projection 930 pushing the inclined leading groove wall 811 of the one of the grooves 82. This results in driving the rotary disc 80 to rotate by an angle of about 2.3° in the clockwise direction. At this time, the projection 930 of the detent member 90 at the first workstation (I) will extend into the next groove 82, the projection 930 of the detent member 90 at the second workstation (II) will move further outward but with a tip thereof in contact with a tip of the engaging tooth 81, and the projection 930 of the detent member 90 at the third workstation (III) will move outward but with the inclined trailing detent surface 9312 still in contact with the inclined trailing groove wall 812 of the one of the grooves 82. Further, the control drive members at the first to third workstations (I, II, III) will not produce operation. The rotary disc 80 and the stitching device 1 will again be locked, so that the sewing needle 101 can accurately execute the stitching operation.

Hence, by repeating the aforesaid operating steps with reference to FIGS. 20 to 23, closing of the toe end 310 of the hosiery body 300 can be accomplished smoothly.

After completing the closing of the toe end 310 of the hosiery body 300, the strip members 62 of the transfer unit 2 are again operated to move downward so that the fork end portions 621 of the strip members 62 can push the sewn loops 320 downward and out of the first reed teeth 24. Preparation for the transfer operation of the next hosiery body 300 can then be executed.

In sum, by using the transfer unit 2 to transfer the toe end 310 of the hosiery body 300 from the knitting machine 200 to the stitching device 1, and by using the sewing needle 101 to execute the stitching operation, in coordination with a limited amount of rotation of the rotary disc 80 of the rotary control unit 3 in an intermittent manner, not only is the object of the present invention can be achieved, but also the entire structure of the present invention is simple and easy to manufacture and assemble, and has low production cost.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. An apparatus for closing a toe end of a tubular hosiery body knitted by a knitting machine, said apparatus comprising:

a stitching device including a main body defining a longitudinal axis and having opposite top and bottom ends, a fixed reed fixed to said bottom end and having a plurality of first reed teeth, a movable reed pivoted to said fixed reed and having a plurality of second reed teeth, and a main drive assembly for driving said movable reed to rotate relative to said fixed reed between a juxtaposed position, where said movable reed is disposed side by side with said fixed reed in a same plane, and a stacked position, where said movable reed is stacked below said fixed reed, said stitching device further including a sewing needle for executing a stitching operation when said movable reed is in said stacked position, said first and second reed teeth mating with each other along an axial direction that is parallel to said longitudinal axis when said movable reed is in said stacked position;

a transfer unit for transferring the toe end of the hosiery body from the knitting machine to said stitching device and for positioning the toe end on said fixed reed and said movable reed; and a rotary control unit including a support frame supporting said main body of said stitching device, a rotary disc attached to said top end of said main body and having a plurality of angularly spaced-apart engaging elements, a plurality of angularly spaced-apart detent members pivoted to said support frame and disposed around said rotary disc, and a plurality of control drive members respectively driving said detent members, each of said control drive members being operative to actuate a respective one of said detent members to drive a limited amount of rotation of said rotary disc, said engaging elements moving past said detent members when said rotary disc is rotated, each of said detent members camming one of said engaging elements that is closed thereto to drive the limited amount of rotation of said rotary disc when actuated by the respective one of said control drive members;

wherein said control drive members consecutively operate to consecutively actuate said respective detent members such that said rotary disc together with said stitching device consecutively produces a limited amount of rotation in an intermittent manner.

2. The apparatus according to claim 1, wherein said main body of said stitching device is a hollow cylinder that defines an accommodating space extending along said axial direction and that has said top and bottom ends, said fixed reed being semicircular in shape and having a first inner surface, and a pair of first pivot lugs that extend downwardly from said first inner surface so as to be disposed on a bottom side of said fixed reed and that are spaced apart at an angle of 180°, said movable reed being semicircular in shape and having a second inner surface, and a pair of second pivot lugs that extend downwardly from said second inner surface so as to be disposed on a bottom side of said movable reed, that are spaced apart at an angle of 180° and that are respectively and pivotally connected to said first pivot lugs, said first and second inner surfaces cooperatively defining a central hole that communicates with said accommodating space when said movable reed is in said juxtaposed position, said main drive assembly including a first rotary wheel pivoted to said main body within said accommodating space and in proximity to said top end thereof, a second rotary wheel fixed to one of said second pivot lugs, a flexible member looped around said first and second rotary wheels, and a main drive member disposed above said main body and driving movement of said flexible member along said axial direction, said movable reed being rotated from said juxtaposed position to said stacked position when said main drive member is actuated.

3. The apparatus according to claim 2, wherein each of said first and second rotary wheels as a sprocket wheel, said flexible member is a roller chain, and said main drive member is a pressure cylinder, said stitching device further including a connecting member that is disposed axially and slidably in said main body, that is connected to said flexible member and that is driven by said main drive member to push said flexible member to move along said axial direction.

4. The apparatus according to claim 3, wherein said stitching device further includes an auxiliary drive assembly, said auxiliary drive assembly including a pushing member disposed axially and slidably in said main body, a biasing member abutting between said main body and said pushing member and biasing said pushing member to move downward, and an auxiliary fork rod connected between said pushing member and said flexible member, said pushing member pushing said flexible member to move downward therealong so as to rotate said movable reed from said stacked position to said juxtaposed position.

5. The apparatus according to claim 4, wherein said connecting member includes a fork rod having a pair of prongs inserted into said flexible member, said auxiliary fork rod also having a pair of prongs inserted into said flexible member, said connecting member and said pushing member being disposed on two opposite sides of said flexible member.

6. The apparatus according to claim 1, wherein said engaging elements of said rotary disc are configured as teeth, each of which tapers radially and outwardly from a periphery of said rotary disc, said rotary disc further having a plurality of V-shaped grooves, each of which is formed between two adjacent ones of said teeth and each of which is defined by two opposite inclined leading and trailing groove walls.

7. The apparatus according to claim 6, wherein each of said detent members includes a detent portion having a projection extendable into each of said grooves, said projection having a shape complementing with that of each of said grooves, and including two opposite inclined leading and trailing detent surfaces, said inclined leading and trailing detent surfaces respectively contacting said inclined leading and trailing groove walls when said projection extends into one of said grooves.

8. The apparatus according to claim 7, wherein each of said detent members further includes a pivot end pivoted to said support frame, and a movable portion connected to said pivot end and having a free end opposite to said pivot end, said detent portion being disposed on said movable portion between said pivot end and said free end.

9. The apparatus according to claim 8, wherein each of said control drive members is a pressure cylinder having a cylinder body fixed on said support frame, and a piston rod retractably protruding from said cylinder body and alignable with said free end of said movable portion.

10. The apparatus according to claim 1, wherein said transfer unit includes a plurality of transfer members corresponding to said first reed teeth, and a plurality of strip members respectively disposed below said transfer members, said transfer and strip members being movable relative to said first and second reed teeth in a direction that is parallel to said longitudinal axis and a direction that is perpendicular to said longitudinal axis.

11. The apparatus according to claim 8, further comprising:

a plurality of angularly spaced-apart workstations around said rotary disc, each of said workstations being provided with one of said detent members and one of said control drive members, wherein, when said control drive member at one of said workstations is operated, said projection of said detent member at said one of said workstations extends into one of said grooves with said leading detent surface of said projection pushing said leading groove wall of said one of said grooves to drive a limited amount of rotation of said rotary disc, and wherein, when said control drive member at one of said workstations is operated, said leading detent surfaces of said projections of the other ones of said detent members do not push said leading groove walls of the corresponding ones of said grooves, respectively.

* * * * *